US007435184B1

(12) United States Patent
Tsujita

(10) Patent No.: US 7,435,184 B1
(45) Date of Patent: Oct. 14, 2008

(54) BOWLING SYSTEM USING NETWORK

(75) Inventor: Masahiro Tsujita, Osaka (JP)

(73) Assignee: Telesystems Co., Ltd., Osaka (JP)

( * ) Notice: Subject to any disclaimer, the term of this patent is extended or adjusted under 35 U.S.C. 154(b) by 0 days.

(21) Appl. No.: 10/276,031

(22) PCT Filed: May 12, 2000

(86) PCT No.: PCT/JP00/03086

§ 371 (c)(1),
(2), (4) Date: Nov. 12, 2002

(87) PCT Pub. No.: WO01/85272

PCT Pub. Date: Nov. 15, 2001

(51) Int. Cl.
*G06F 19/00* (2006.01)

(52) U.S. Cl. ..... 473/54; 473/70; 463/42

(58) Field of Classification Search ..... 473/54, 473/70; 700/91; 463/42
See application file for complete search history.

(56) References Cited

U.S. PATENT DOCUMENTS

| | | | | |
|---|---|---|---|---|
| 5,198,976 | A | 3/1993 | Form et al. | |
| 5,709,607 | A * | 1/1998 | Mowers et al. | 473/58 |
| 6,430,453 | B1 * | 8/2002 | Shea | 700/91 |
| 6,580,954 | B1 * | 6/2003 | Shea | 700/91 |
| 6,623,369 | B1 * | 9/2003 | Shea | 473/57 |
| 2002/0010032 | A1 * | 1/2002 | Stiteler | 473/54 |

FOREIGN PATENT DOCUMENTS

| | | | |
|---|---|---|---|
| JP | S56-60583 | A | 5/1981 |
| JP | H10-162067 | A | 6/1998 |
| JP | H10-198518 | A | 7/1998 |
| JP | H10-295873 | A | 11/1998 |
| JP | H11-267361 | A | 10/1999 |
| JP | H11-319312 | A | 11/1999 |
| JP | 2000-51519 | A | 2/2000 |
| WO | WO99/11343 | | 3/1999 |

* cited by examiner

*Primary Examiner*—Robert E Pezzuto
*Assistant Examiner*—Alex F. R. P. Rada, II
(74) *Attorney, Agent, or Firm*—Pillsbury Winthrop Shaw Pittman LLP

(57) ABSTRACT

A bowling system comprises bowling centers (C1-C3) where an information terminal IT is provided for each lane, a data management center (DMC), a financial institution (BK), and the Internet (INT). The data management center (DMC) collects frame data from each bowling center, stores it therein in a centralized way, and distributes game information at suitable timings. Also, the data management center (DMC) is provided with a multimedia bulletin board (MM) and a bowler in any bowling center can communicate with another bowler by using functions of the bulletin board of registering, posting, searching, selecting, and retrieving information (text, sound, and image).

11 Claims, 54 Drawing Sheets

FIG.10

| | CENTER A | CENTER B | CENTER C |
|---|---|---|---|
| GAME RATE | ¥5,000 | ¥3,000 | ¥4,000 |
| CHARGE (10%) | ¥500 | ¥300 | ¥400 |
| POINT SYSTEM CHARGE | ¥300 | ¥180 | (SYSTEM NOT ADOPTED) |
| **TOTAL of PAYMENTS** | **¥800** | **¥480** | **¥400** |

FIG.12

| | CENTER A | CENTER B | CENTER C |
|---|---|---|---|
| PARTICIPATE FEE | ¥80,000 | ¥100,000 | ¥90,000 |
| CHARGE (10%) | ¥8,000 | ¥10,000 | ¥9,000 |
| COST of PREMIUMS | ¥12,000 | ¥15,000 | ¥13,500 |
| **TOTAL of PAYMENTS** | **¥20,000** | **¥25,000** | **¥22,500** |

FIG.14

| | CENTER A | CENTER B | CENTER C |
|---|---|---|---|
| PAYMENT | ¥270,000 | ¥0 | ¥0 |
| PARTICIPATE FEE | ¥80,000 | ▲¥100,000 | ▲¥90,000 |
| CHARGE (10%) | ¥8,000 | ¥10,000 | ¥9,000 |
| PAYMENT to CENTER B | ¥100,000 | ¥0 | ¥0 |
| PAYMENT to CENTER C | ¥90,000 | ¥0 | ¥0 |
| **TOTAL of PAYMENTS** | **¥198,000** | **▲¥90,000** | **▲¥81,000** |

FIG.16

| ITEM | PAYMENT |
|---|---|
| CHARGE (10%) | ¥14,000 |
| PAYMENT to CENTER A | ¥27,000 |
| PAYMENT to CENTER B | ¥45,000 |
| PAYMENT to CENTER C | ¥54,000 |
| AD CHARGE | ¥140,000 |

FIG.18

| | CENTER A | CENTER B | CENTER C | DATA MANAGE-MENT CENTER |
|---|---|---|---|---|
| ① | ▲¥800 | ▲¥480 | ▲¥400 | ¥1,680 |
| ② (CHARGE) | ▲¥8,000 | ▲¥10,000 | ▲¥9,000 | ¥27,000 |
| ② ( COST of PREMIUM ) | ▲¥12,000 | ▲¥15,000 | ▲¥13,500 | ¥0 |
| ③ | ▲¥198,000 | ¥90,000 | ¥81,000 | ¥27,000 |
| ④ | ¥27,000 | ¥45,000 | ¥54,000 | ¥14,000 |
| **PAYMENT BALANCE** | **▲¥191,800** | **¥109,520** | **¥112,100** | **¥69,680** |

FIG.32

OOTOURNAMENT

CENTER A QUALIFYING GROUP A

PARTICIPANTS

| NAME | NAME |
|---|---|
| A① | A③ |
| A② | A④ |

FIG.37

OOTOURNAMENT

INTERIM STATUS (GAME ONE OVER)

CENTER B QUALIFYING GroupD

| NAME | POINT |
|---|---|
| D① | 50p |
| D② | 50p |
| D③ | 0p |
| D④ | 0p |

Group A | Group B | Group C | MENU

FIG.39

BULLETIN BOARD : PAST TOURNAMENT RESULT

OOTOURNAMENT

| RANK | NAME | POINT | CENTER | RANK | NAME | POINT | CENTER |
|---|---|---|---|---|---|---|---|
| 1 | B② | 350p | CENTER A | 5 | A③ | 250p | CENTER A |
| 2 | C③ | 345p | CENTER B | 5 | D② | 250p | CENTER B |
| 3 | D① | 340p | CENTER B | 7 | A① | 245p | CENTER A |
| 4 | B② | 350p | CENTER A | 8 | C④ | 240p | CENTER B |

PREVIOUS NEXT MENU

FIG.48

| | 1 | 2 | 3 | 4 | 5 | 6 | 7 | 8 | 9 | 10 |
|---|---|---|---|---|---|---|---|---|---|---|
| 鈴木 太郎さん | 9 ◢ 18 | 8 ⋈ 45 | 6 ⋈ 63 | 7 1 71 | 8 1 80 | | | | | |
| 鈴木 洋子さん | G 9 9 | 7 ◢ 27 | 8 1 36 | 4 3 43 | ← | | | | | |

Game 1

YOKO SUZUKI -- BOWL A BALL

BOWLING SYSTEM USING NETWORK

FIELD OF THE INVENTION

The present invention relates to a bowling system using network which enables a bowling game to be played among a plurality of bowling centers by use of a general-purpose network tipified by the Internet.

DESCRIPTION OF THE RELATED ART

Bowling systems presently in widespread use are closed systems in which data processing can be carried out exclusively within a single bowling center. Specifically, an office computer is provided for centralized processing and storing of personal information of bowlers located on each lane and transaction information such as game information or sales information, and operations as of charge processing or game control are performed by centralizing all such information in the office computer. In those bowling systems, however, the operations of control and processing have been performed in a closed manner within each bowling center, which has caused the following problems. First, onerous manual procedures have been required in a tournament or a free-time competition that is held concurrently among bowling centers far apart from one another. Secondly, there has been a limit to the operations of control or count since information on game progress halfway through a bowling game has not been provided in real time.

It is an object of the present invention to provide a bowling system using network that enables centralized control in a data management center of center systems of a plurality of bowling centers by connecting the center systems of the respective bowling centers and the data management center via a general-purpose network such as the Internet, thereby allowing a large variety of bowling games to be played among a plurality of bowling centers.

SUMMARY OF THE INVENTION

A bowling system using network of the present invention comprises:

a center system of a bowling center comprising information terminals to interface with bowlers which are provided one for each lane, and further processing transaction information such as game information or sales information; and a data management center which is connected with the center system of each bowling center via a general-purpose network thereby processing and storing the transaction information therein in a centralized way, wherein the center system, as well as transmitting to the data management center game information of bowlers with each game progress made within at least a frame, receives from the data management center game progress information according to a game type, processes the information, and displays the result on the information terminals; and the data management center transmits game information received from the center system to all center systems registered therewith, thereby enabling a bowling game to be played among bowlers located at remote locations via the general-purpose network.

This bowling system using network enables a bowling game to be played in real time among bowling centers far apart from one another since game information is transmitted to the data management center with each game progress made within at least a frame. Game information (i.e. data on scores, remaining pins, ball speed, etc.) is transmitted to the data management center in every frame, for example, and therefore game progress information for a frame of a bowler located in a bowling center is displayed on a predetermined information terminal provided in the bowling center immediately after the bowler finishes bowling for the frame. The predetermined information terminal is an information terminal registered with the data management center, and the game progress information displayed thereon is normally game scores.

This configuration enables a tournament to be held concurrently, or a competition to be held by a lot of people within a specific time period, among a plurality of bowling centers.

Further, in the present invention the data management center is provided with a bulletin board where communication information among bowlers in respective bowling centers is registered, thereby enabling the bowlers in the respective bowling centers to exchange communication information with one another.

One distinguishing hardware component of the present invention is the bulletin board, where communication information among bowlers in the respective bowling centers is registered thereby enabling the bowlers in the respective bowling centers to exchange communication information with one another. If a bowler registers as communication information his or her name, brief self-introduction, highest game score, or the like, the bowler can play a game with another bowler at some remote location who takes notice of the information. Also, men's team and women's team get acquainted with each other via the bulletin board to be able to play a bowling game between different bowling centers. Even bowlers who are altogether unacquainted with each other can play a bowling game together. The bulletin board is highly effective in the bowling system using network. In a case where bowlers who are completely unacquainted with one another play a bowling game among a plurality of bowling centers, the bulletin board enables mutual communication among the bowlers and therefore great enhancement of fun of the bowling game.

According to the present invention, moreover, each information terminal has a camera for taking bowlers' face images and a microphone for picking up sound generated by bowlers connected thereto, such that multimedia information such as the face images taken with the camera and the sound picked up through the microphone can be registered as communication information on the bulletin board.

The bulletin board as used in the present invention also serves as a medium by which multimedia information including not only text information but also image or audio information can be exchanged. Face images of bowlers and sound generated by bowlers can be exchanged via the bulletin board among bowlers who are far apart from one another, which results in further enhancement of fun of a bowling game.

Furthermore, the data management center of the present invention is provided with a settlement server for settling expenses regarding network-related games incurred by each bowling center.

With the data management center provided with the settlement server, costs of running the data management center can be apportioned fairly among the bowling centers. In addition, the processing of such settlement can be carried out quickly and accurately. Settlement in bank accounts can be also facilitated by connecting the data management center with banks. Inter-account settlement can be also made easily among bank accounts of respective bowlers, the bowling centers, and the data management center.

The settlement server of the present invention also makes settlement of advertising revenues to be alloted to each bowling center.

Advertising on information terminals is quite easy since each information terminal is connected with the data management center via a general-purpose network. With no particular contrivance added, advertising on the information terminals can be facilitated by distributing advertisements from the data management center to the information terminals in each bowling center. Advertising revenues are alloted to each bowling center in accordance with predetermined rules. This arrangement brings mutual advantage to both of the bowling centers and advertisers.

A tournament via a general-purpose network is a typical game example of the bowling system using network of the present invention. The tournament is held among bowling centers either simultaneously or at different time on different days. If the game is held in bowling centers located in places with time difference among one another (in Japan and the United States, for instance), each of the bowling centers usually has a different game start time. If the game is held in bowling centers with no time difference between one another (as in bowling centers located in Tokyo and Osaka), on the other hand, the game is usually started at the same time. In either case, game progress information in the other bowling centers can be displayed in real time on information terminals in any one bowling center via the data management center. This arrangement enables a tournament to be easily held concurrently among a plurality of bowling centers located within a particular country, or even an international tournament to be easily held on the same day, such tournaments having been wholly impossible.

In a tournament a ranking list is made for the game. The ranking list (game score data included) can be made open to the public by use of the bulletin board. The game ranking list is made up instantly in the data management center and then posted on the bulletin board. The ranking list can be viewed by not only participating bowlers in the game but also anyone with access right to the bulletin board. It is convenient, for instance, when a professional tournament is being held. Access to the bulletin board makes the ranking list for the tournament available to anyone interested in the game result with ease at any time. Requirements for access right to the bulletin board may be set in any way (for example, by making a distinction between free and toll access). It is also possible to make the bulletin board accessible from portable phones (cellular phones).

Another typical game example of the bowling system using network of the present invention is a competition, which falls into free-time and fixed-time competitions. A free-time competition is a competition with its start time unfixed, participation in which is free within a specific time period. A fixed-time competition is a competition with its start time fixed, starting at a particular time on a particular date. While the competition is being held, the information terminals in each bowling center have messages confirming bowlers' intention to participate in the competition, explaining the game, or the like displayed on display screens thereof. It is also possible to display on the information terminals a temporary ranking list at a given point at request of bowlers and further to post the ranking list on the bulletin board.

The bowling system using network of the present invention further enables a challenge match, a matchup, and the like. A challenge match is a game in which a bowler plays against past or virtual game information. Past game information to be used may be either the bowler's own or another bowler's past game information. When another bowler's past game information is in use in a challenge match, the game progresses as if it were being actually played with that bowler. It is possible to set game information disguised as a celebrity's or a professional bowler's game information for opponent game information. Virtual game information is game information that is arbitrarily made. Such a game mode is referred to as a virtual mode in the present invention. A bowling game played in the virtual mode results in a great increase in fun.

A matchup is a game played by solo bowlers or teams of bowlers among a plurality of bowling centers. The above-described bulletin board can be effectively used in a matchup. On the bulletin board, information on bowlers or teams of bowlers who hope to play a matchup with solo bowlers or teams of bowlers is registered as communication information, thereby enabling bowlers with their information registered on the bulletin board to be selected as opponents in a matchup. The center system receives and processes game progress information of a matchup, and displays the processed result on the information terminals provided for lanes where bowlers participating in the game are located. Thus, the use of the bulletin board enables bowlers to seek, search, and select bowlers to play a game with, and consequently to play a game with unacquainted solo bowlers or teams of bowlers at remote locations.

There is a great variety of matchups conceivable. It is possible, for instance, to use the bulletin board to seek either women or men only, such that men's and women's groups can get acquainted with each other via the bulletin board to play a game together. This type of game can promote fun of a bowling game, in particular to groups of young people. It is also possible to make a free combination of team members in a case of a matchup held among a plurality of bowling centers. Let us now suppose, for example, that there are one group of two persons a and b in a bowling center A, and another group of two persons c and d in a bowling center B. In this case the persons a and c can form a team X, and the persons b and d can form a team Y, such that teams X and Y can play a match. In addition, it is possible to play a matchup for a game charge (a showdown game). If a matchup is played under a rule that the winner of the game does not need to pay for the game while the loser makes payment of the full amount of the game charge, for example, there can be a further increase in fun.

BRIEF DESCRIPTION OF THE DRAWINGS

FIG. 10 is a table showing a settlement example;

FIG. 12 is a table showing another settlement example;

FIG. 14 is a table showing still another settlement example;

FIG. 16 is a table showing yet another settlement example;

FIG. 18 is a table showing receipts and disbursements accounts balanced among respective bowling centers and the data management center;

FIG. 32 shows an example of overhead screen display;

FIGS. 34 through 37 show examples of screen display on the information terminal;

FIG. 39 shows another example of screen display on the information terminal;

FIGS. 44 through 49 show examples of screen display for a challenge match on the information terminal;

BEST MODES FOR CARRYING OUT THE INVENTION

Figure 1:
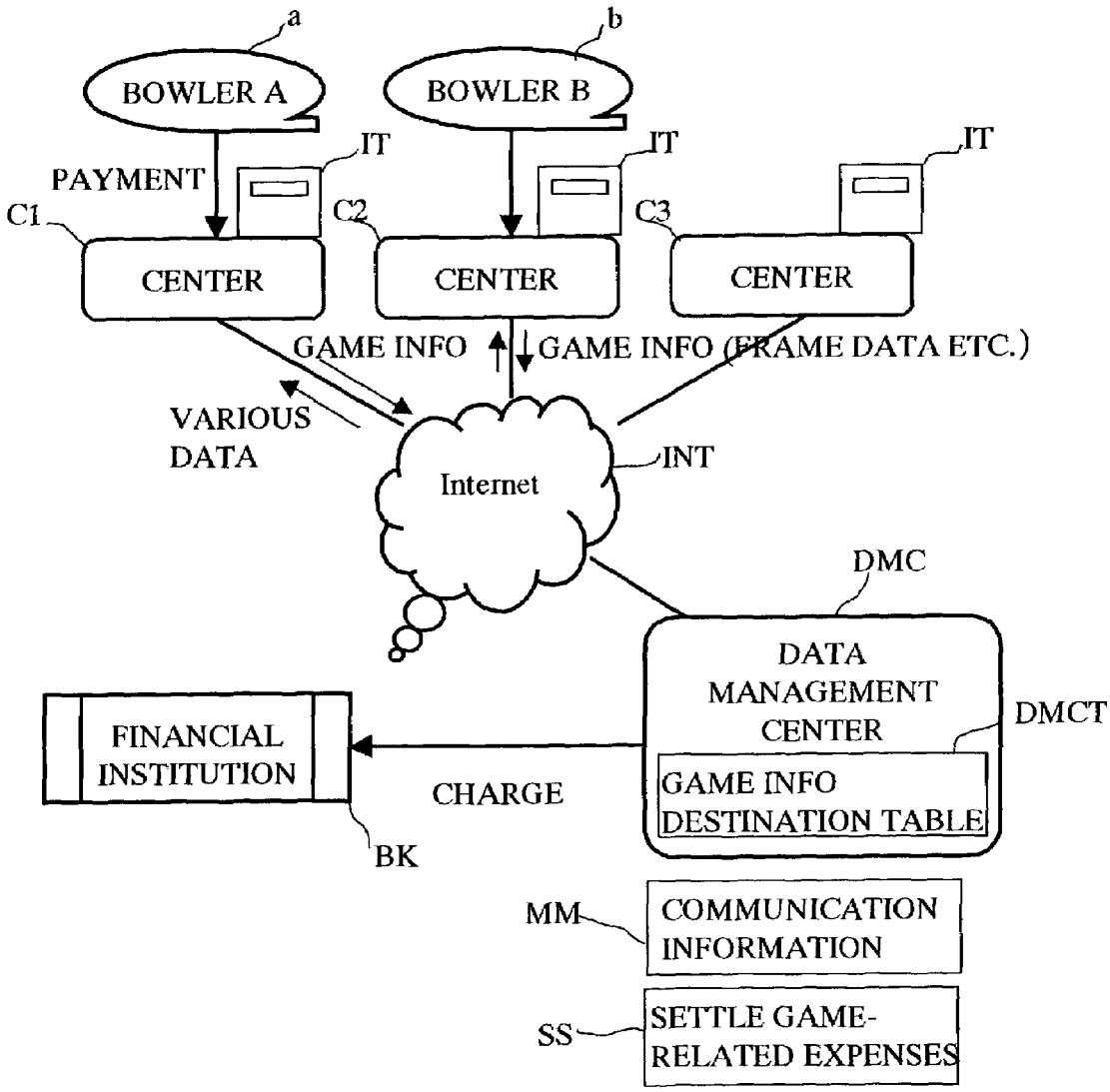
FIG. 1 is a system configuration diagram of a bowling system using network according to an embodiment of the present invention.

FIG. 1 is a system configuration diagram of a bowling system using network according to an embodiment of the present invention.

This bowling system comprises bowling centers C1 to C3, a data management center DMC, a financial institution BK, and the Internet INT.

The bowling centers C1 to C3 are inclusive of bowling centers located not only within a particular country but also in any country in the world. The data management center DMC collects frame data from each bowling center C, processes and stores the data therein in a centralized way. The data management center DMC also distributes game information to each bowling center C at suitable timings, and has resultant data from centralized processing downloaded by each bowling center C. The data management center DMC is provided with a multimedia bulletin board MM on which communication information among bowlers is registered. The multimedia bulletin board MM has a function of registering text, sound, and image (still and moving) information thereon. The multimedia bulletin board MM has functions of registration, posting, search, selection, and retrieval of information. By using the functions a bowler in any bowling center can communicate with another bowler in another bowling center.

Each bowling center C(C1, C2, C3, . . . ) has information terminals IT provided one for each lane. The information terminals IT interface with bowlers, and have game scores or various information displayed on display surfaces thereof, and input units provided which enables bowlers to input various information. As well as with the information terminals IT provided one for each lane, the bowling center C is provided with a center server for processing transaction information such as game information or sales information. It is possible to endow each information terminal IT with the function of the center server. It is also possible to endow with the function of the center server an office computer, a front control device, or the like which has been provided in existing bowling centers.

In the present invention, hereinafter referred to as a center system is a system which is provided with the information terminals IT and has the function of processing transaction information. The center system is provided for each of the bowling centers C1, C2, C3, respectively. Accordingly, each center system and the data management center DMC are connected to the Internet INT, and data are transmitted and received among one another via the Internet INT.

It is possible further to connect a financial institution BK to the data management center DMC, such that information for settlement may be sent to accounts in the financial institution BK.

The data management center DMC is furthermore provided with a game information distribution destination table DMCT for registering game information distribution destinations. The table DMCT is a lookup table on which registered are information terminals IT in bowling centers where the data management center DMC distributes frame data which is included in game information received from a bowling center. On receipt of frame data from a bowling center, the data management center DMC identifies destinations to distribute the frame data to, by looking up on the game information distribution destination table DMCT, and then distributes the frame data to all the destinations concurrently.

The following four items (1) to (4) are the distinguishing features of the foregoing bowling system using network.

(1) A plurality of bowling centers C and the data management center DMC are connected to the Internet INT, and the data management center DMC is provided with the game information distribution destination table DMCT on which registered are destinations where frame data included in game information is distributed. The registered destinations generally include not only the IDs of bowling centers but also the IDs of information terminals IT provided in the bowling centers for successful data distribution.

Existing bowing centers have closed forms of data processing, wherein bowler information and transaction information in a bowling center is all processed within the center. In the bowling system according to the embodiment of the present invention, by contrast, bowler information and transaction information in a bowling center is open to the outside and under central control of the data management center DMC, thereby enabling a bowling game to be held among a plurality of bowling centers at remote locations. In addition, bowler information may be controlled separately in each bowling center C such that the data management center DMC can grasp such a state of separate control of the information. In this case, the data management center DMC is provided with a lookup table for looking up bowler IDs and bowler information control centers (bowling centers).

Also, the concurrent distribution of frame data to the destinations registered facilitates a game played among a plurality of bowling centers.

(2) Game information transmitted from each bowling center C to the data management center DMC is basically per-frame data, including data on scores, remaining pins, ball speed, and the like. This data is referred to as frame data. Since information transmitted to the data management center DMC during a game is frame data, there is not a long delay caused in the processing of game information in the data management center DMC. In a case where a game is being played concurrently among a plurality of bowling centers, therefore, score information of the other bowling centers is displayed in each bowling center with a delay of just a frame at the maximum. Since the delay of a frame in displaying game information does not cause much trouble in a bowling game, there is little trouble caused even in a tournament held among a plurality of bowling centers at remote locations. With a delay of more than a frame in distributing score information in a tournament or matchup, reality of the game is lost and bowlers' interest in the game in progress is diminished. The present embodiment enables smooth game progress even in a tournament or the like which is held among a plurality of bowling centers since game information transmitted from each bowling center C to the data management center DMC is frame data. In addition, instead of frame data, which is data for one frame, data per bowl may be transmitted to the data management center DMC as in-frame data since there is data for two bowls in a frame other than in the $10^{th}$ frame. If game information transmitted from each bowling center C to the data management center DMC is the in-frame data there will be less delay in displaying the score.

(3) The data management center DMS is provided with the bulletin board.

The bulletin board is a medium by which bowlers in respective bowling centers C communicate with one another. The bulletin board has functions of registration, posting, search, selection, and retrieval of information. If a bowler a registers information such as the bowler's profile on the bulletin board, a bowler b can select the profile by using the functions of search and selection, and then make the profile displayed on the information terminal IT provided for a lane where the bowler b is located, by using the function of retrieval. The use of the bulletin board thus enables registration of bowlers' profile, declaration of bowlers' intention to play a match, display of scores after the game is over, and the like.

In the system shown in FIG. 1 the multimedia bulletin board MM is provided as the bulletin board. The multimedia bulletin board MM can handle text, sound, and image (still and moving) information, thereby enabling exchange of still and moving images and sound among bowlers at remote locations, such that a more enjoyable game can be expected.

(4) The data management center DMC is provided with the settlement server SS.

The settlement server SS is a server for automatically settling game-related expenses, which include game charge, costs of running the data management center DMC, and the like. When connected to the financial institution BK, the settlement server SS also makes inter-account settlement among bank accounts of respective bowlers, bowling centers C, and the data management center DMC. When advertisers put advertisements on the information terminals IT, the settlement server SS also makes settlement of dividends of advertisement revenues to each bowling center C.

In the bowling system using network shown in FIG. 1, the aforementioned features (1) to (4) in system configuration enables transaction information, which has been conventionally processed in a closed manner within each bowling center, to be processed in a centralized way over all the bowling centers that are connected to the Internet INT. As a consequence, it becomes possible to play a variety of games which have been conventionally impossible, as will be described later in detail.

Figure 2:
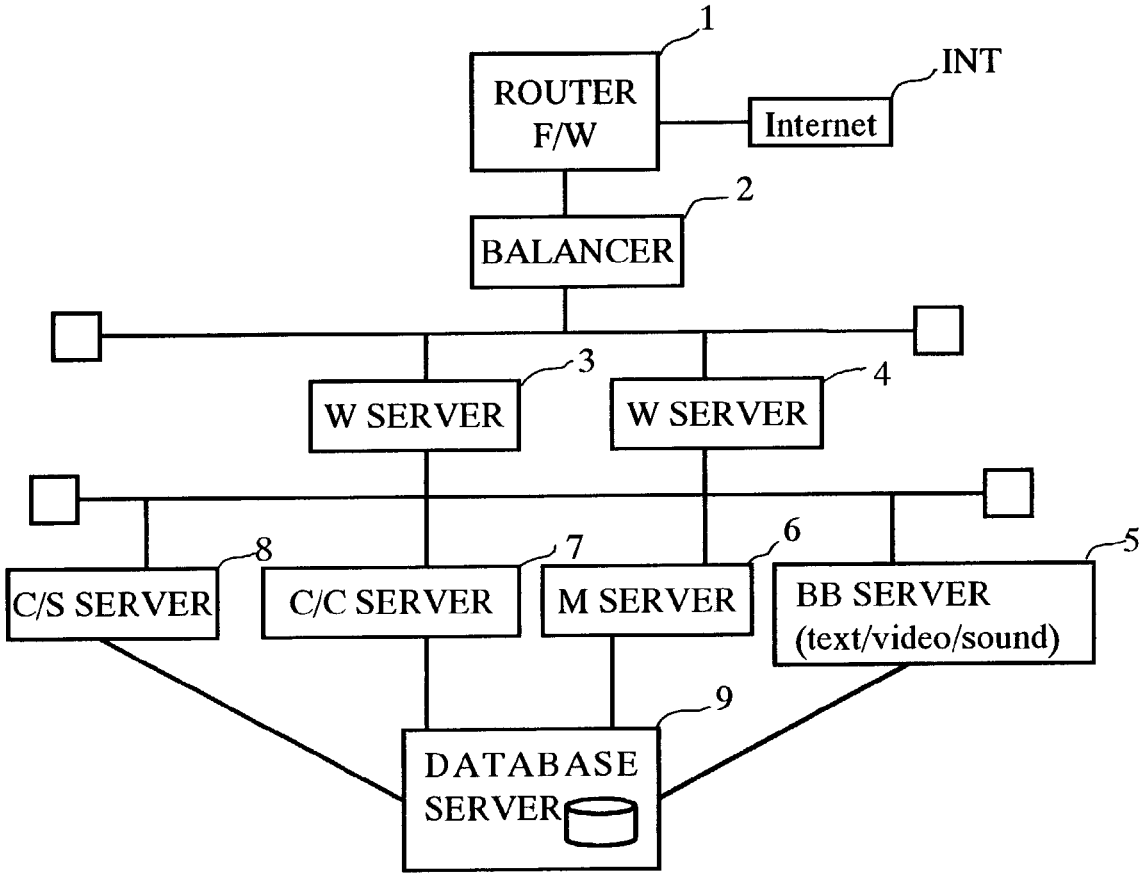
FIG. 2 is a configuration diagram of the internal system of a data management center DMC.

FIG. 2 is a configuration diagram of the internal system of the data management center DMC.

Two web servers 3, 4 are connected to the Internet INT via a router 1 with firewall and a load balancer 2 such that a load can be balanced between the two web servers. Connected to the web servers 3, 4 are a bulletin board server 5, a mail server 6, a game control/count server 7, and a charging/settlement server 8, all of which are connected to a database server 9.

The bulletin board server 5, which corresponds to the multimedia bulletin board MM shown in FIG. 1, can handle text, video (moving image), and sound in the embodiment. The mail server 6 is a server for processing in each bowling center C exchange of e-mail messages among respective bowling centers C, bowling clubs, bowler groups, or individual bowlers. The game control/count server 7 controls a bowling game played in each bowling center C and counts game information. The charging/settlement server 8, which corresponds to the settlement server SS shown in FIG. 1, performs the processing of charging to each bowling center C or bowler and various types of settlement as described above. The database server 9 stores therein as a database all transaction information and bowler information required for such processing. The database also includes the game information distribution destination table DMCT according to the present invention.

Figure 3:
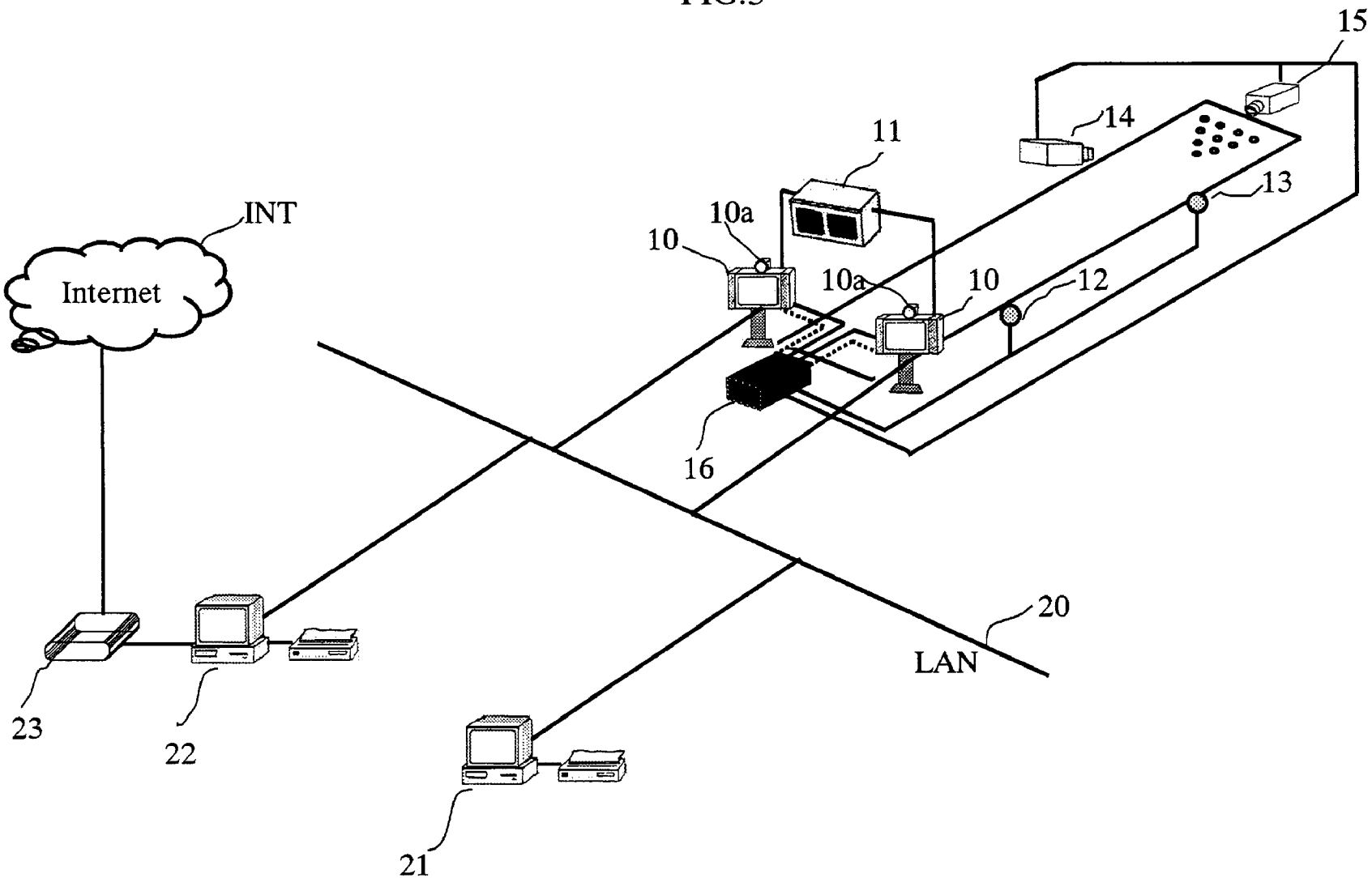
FIG. 3 is a configuration diagram of a center system provided for each bowling center C.

FIG. 3 is a configuration diagram of a center system provided for each bowling center C. Information terminals 10 are provided one for each lane in order to interface with bowlers. On a display screen of each information terminal 10 bowlers can confirm scores or search, select, and retrieve information registered on the bulletin board. Also provided are a microphone (not shown) and a camera 10*a* for taking bowlers' face images. It is possible to register bowlers' face images taken with the camera 10*a* and bowlers' voices picked up with the microphone on the bulletin board as communication information via the information terminals 10. An overhead CRT 11 is a CRT monitor provided one for each lane, displaying scores and other images thereon. Ball sensors 12 and 13 are provided for each lane for detecting a roll of a ball. The ball sensor 12 is located near a bowler and the ball sensor 13 near pins. Further provided are a camera 15 for taking images of bowlers' bowling form and a camera 14 for taking images of pin action, and image signals are supplied also to the information terminals 10 via a control box 16. The ball sensors 12, 13 are used for switching the cameras 14, 15. In a specific time period after a ball rolls past the ball sensor 13, the camera 14 takes a still image of the remaining pins, such that the remaining pins can be detected by image processing based on the still image.

Each information terminal 10 has an ID of its own for discriminating purpose, and the ID is registered on the game information distribution destination table DMCT in the data management center DMC when it is necessary for the information terminal 10 to receive game information from the data management center DMC via the Internet. In practice, IDs of each bowling center C and each information terminal 10 are registered on the game information distribution destination table DMCT. Specifically, in cases in which games as described later are held, the IDs of bowling centers C where the games are held and the information terminals 10 provided in the bowling centers C are all registered on the game information distribution destination table DMCT before the games start. If a non-player in the game hopes to continuously receive game information automatically, the ID of an information terminal 10 through which the non-player receives the information is also registered on the game information distribution destination table DMCT, together with the ID of a bowling center C where the information terminal 10 is provided. In this case, if a medium by which game information is received is not the information terminal 10 but a terminal device such as a cellular phone, the ID of the terminal device is registered.

The control box 16 is connected with all of the information terminals 10, the overhead CRT 11, the ball sensors 12, 13 and the cameras 14, 15, for performing all the processing of sensor input/output, communication, image display and the like.

The information terminals 10 provided one for each lane are connected to a LAN 20, and a front control device 21 and a center server 22 are also connected to the LAN 20. The front control device 21 is located at a front desk in a bowling center, having control over the whole of operations with respect to each lane. The center server 22 processes bowler information and transaction information, such as game or sales information, transmits the processed data to the data management center DMC, and receives various data from the data management center DMC. The center server 22 is connected to the Internet INT via a router 23.

Figure 4:
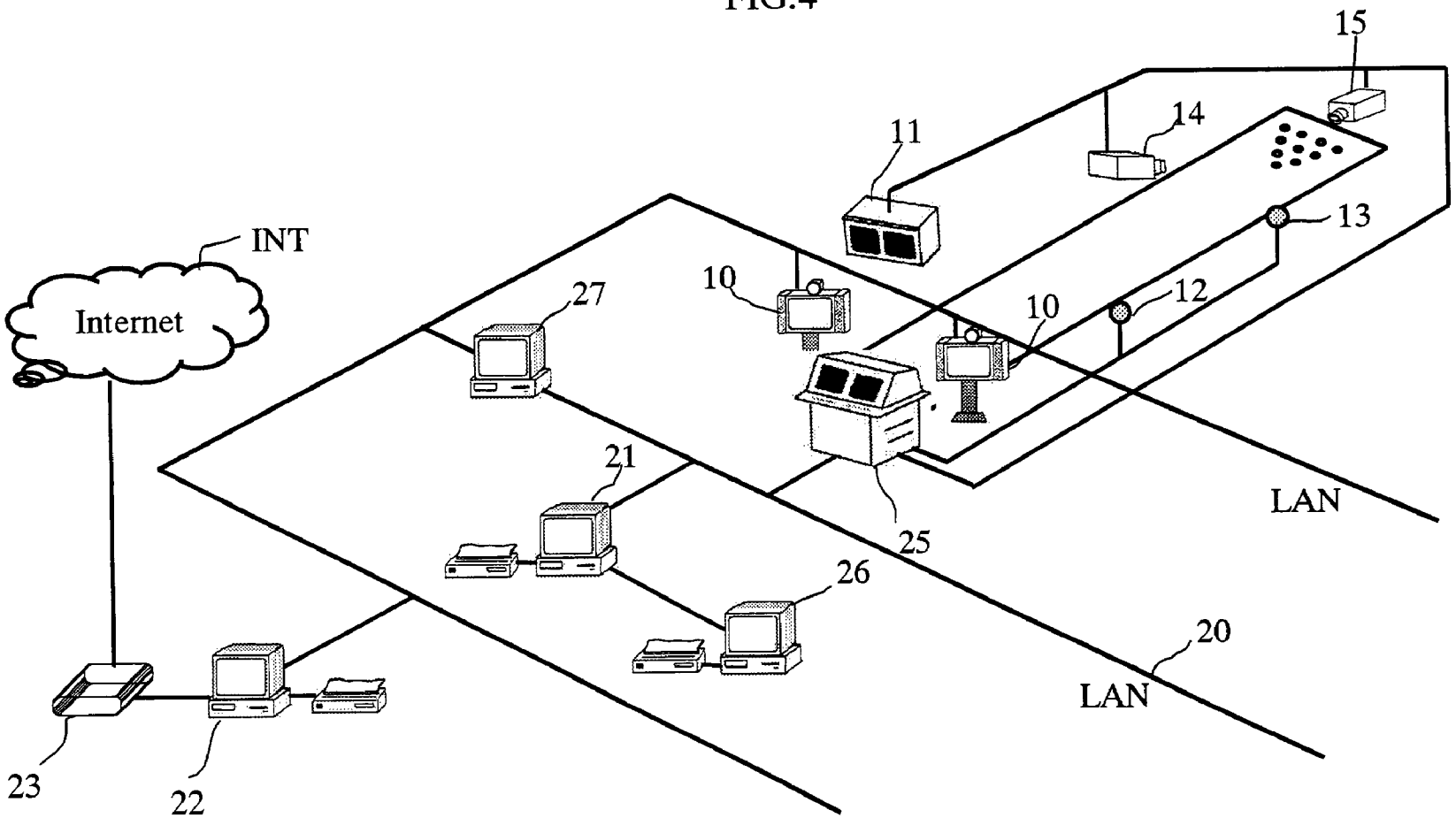
FIG. 4 is a configuration diagram of a center system of another type.

FIG. 4 is a configuration diagram of a center system of another type.

This center system is different in configuration from the center system shown in FIG. 3 in that a console 25 instead of the control box 16, an office computer 26, and a hook PC 27 are provided. The console 25 and the office computer 26 are devices which have been provided in existing closed bowling centers. In this center system, the system configuration with the console 25, the front control device 21, and the office computer 26 as its central base is used without change in such a way as to have the same function of the center system shown in FIG. 3. In the center system shown in FIG. 4, therefore, the information terminals 10, the hook PC 27, and the center server 22 are newly provided for the existing system. On the information terminals 10 with display units provided thereon, the same display contents may be displayed as on the display unit of the console 25. Since the existing console 25 has a limited display function, however, display screens of the information terminals 10 are used for displaying contents which the console 25 is incapable of displaying. The hook PC 27 has a function of extracting data exchanged between the console 25 and the front control device 21 and then transmitting the extracted data to the center server 22. Since bowler information and transaction information are exchanged between the console 25 and the front control device 21, the information are extracted and then transmitted to the center server 22 by the hook PC 27. Consequently, the center server 22 is allowed to transmit bowler information and transaction information to the data management center DMC and also to receive information from the data management center DMC, process the information, and then display the processed result on the information terminals 10.

Figure 5:
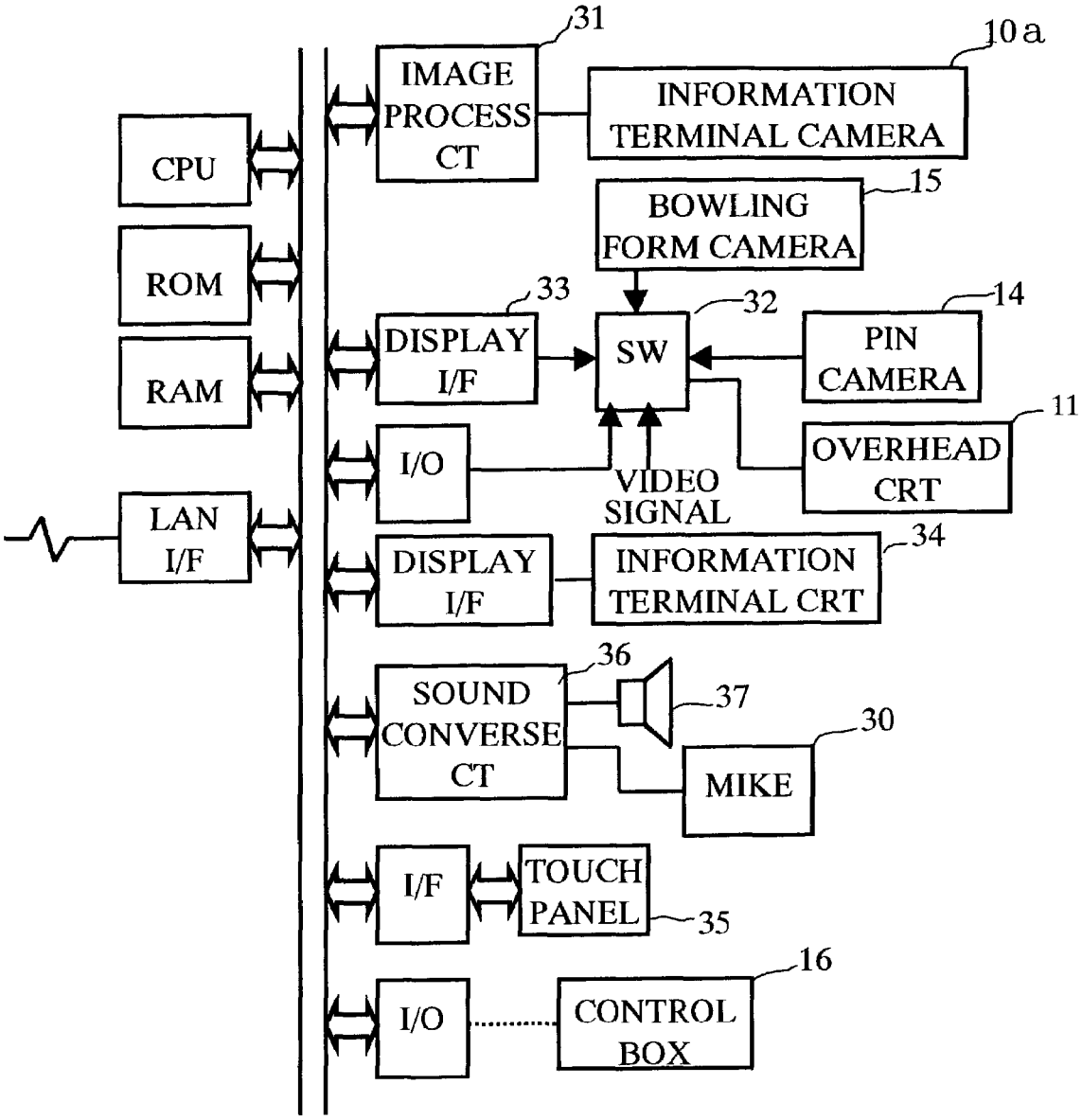
FIG. 5 is a configuration diagram of an information terminal 10 shown in FIG. 3.

FIG. 5 is a configuration diagram of the information terminal 10 shown in FIG. 3.

Information is entered into the information terminal 10 from the information terminal camera 10*a*, the control box 16, and a microphone 30. Image information from the information terminal camera 10*a* is processed in an image processing circuit 31. Image signals from either the bowling form camera 15 or the pin camera 14, which are transmitted from the control box 16, are outputted on the overhead CRT 11 through a changing-over switch 32. Image signals produced in the information terminal 10 and the like are also displayed on the overhead CRT 11 via a display interface 33. It is possible, furthermore, to display video signals selectively on the overhead CRT 11. The information terminal 10 has an information terminal CRT 34 with touch panel provided on its front surface, for serving as an interface between bowlers and the information terminal 10. The microphone 30 picks up sound generated by bowlers and then processes the sound for compression in a sound conversion circuit 36 in order to create information to be transmitted to the bulletin board in the data management center DMC. A touch panel 35 is provided on the CRT faceplate of the information terminal CRT 34. A speaker 37 outputs sound included in multimedia information to a bowler.

Figure 6:
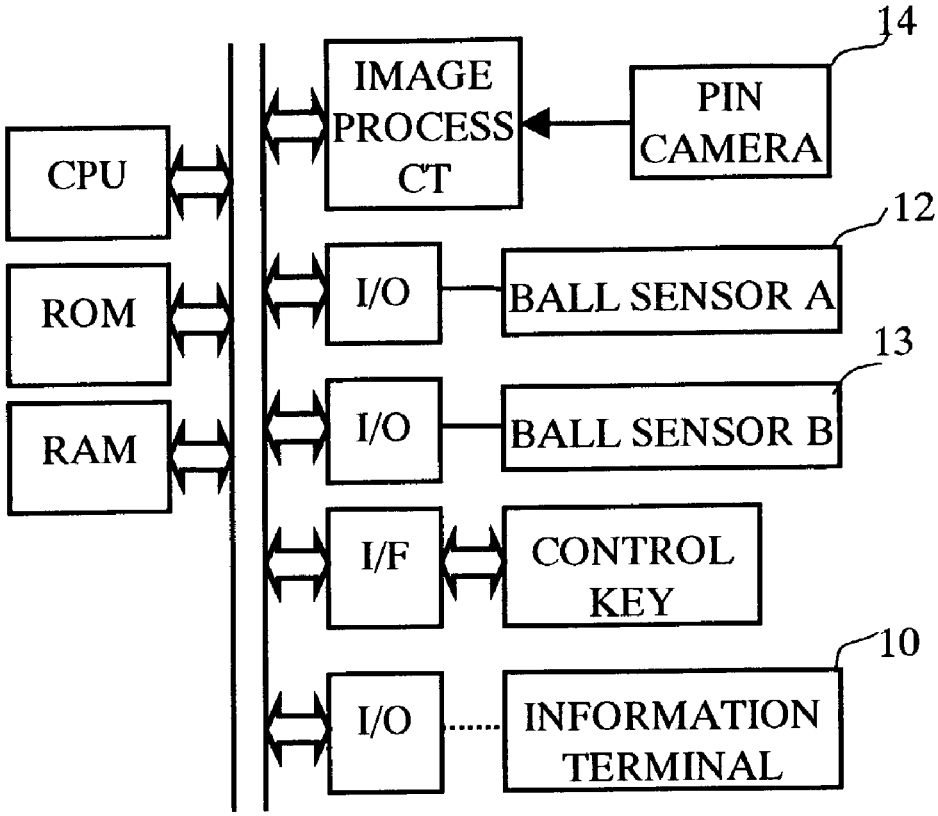
FIG. 6 is a configuration diagram of a control box 16 shown in FIG. 3.

FIG. 6 is a configuration diagram of the control box 16 shown in FIG. 3.

Entered into the control box 16 as used in the center system are signals from the ball sensors 12 and 13 and also signals from the pin camera 14.

Figure 7:
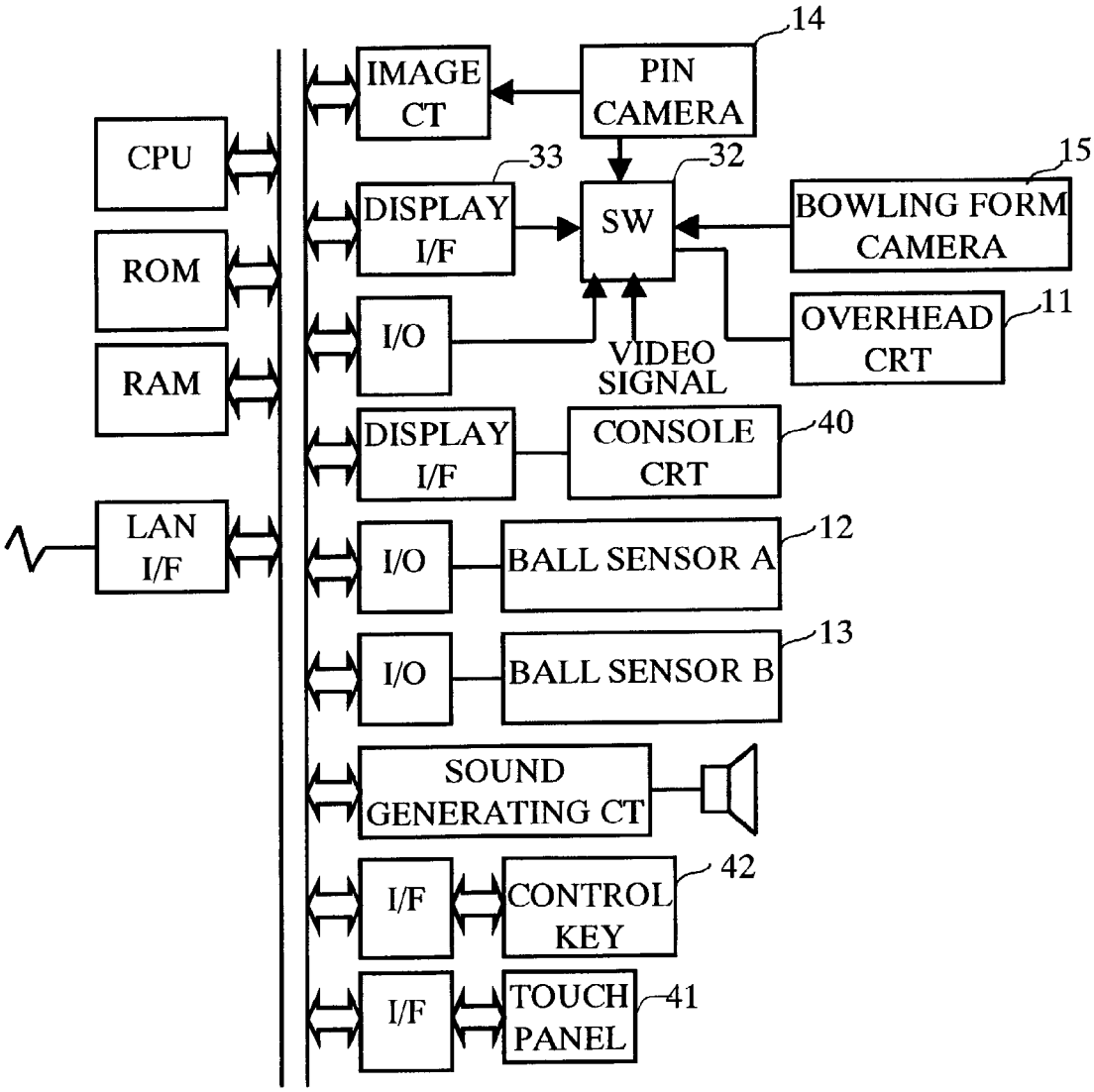
FIG. 7 is a configuration diagram of a console 25 in the center system shown in FIG. 4.

FIG. 7 is a configuration diagram of the console 25 in the center system shown in FIG. 4. The console 25 has been provided for existing bowling centers. Signals from the pin camera 14 and the bowling form camera 15, video signals, and image signals from the display interface 33 and the like are entered through the changing-over switch 32, and either of the signals are outputted on the overhead CRT 11. Also provided are a console CRT 40 for displaying scores or the like to a bowler, a touch panel 41 provided on the display screen of the CRT, and an input unit including a control key 42. The changing-over switch 32 is controlled by signals inputted into the console 25 from the ball sensors 12, 13.

Figure 8:
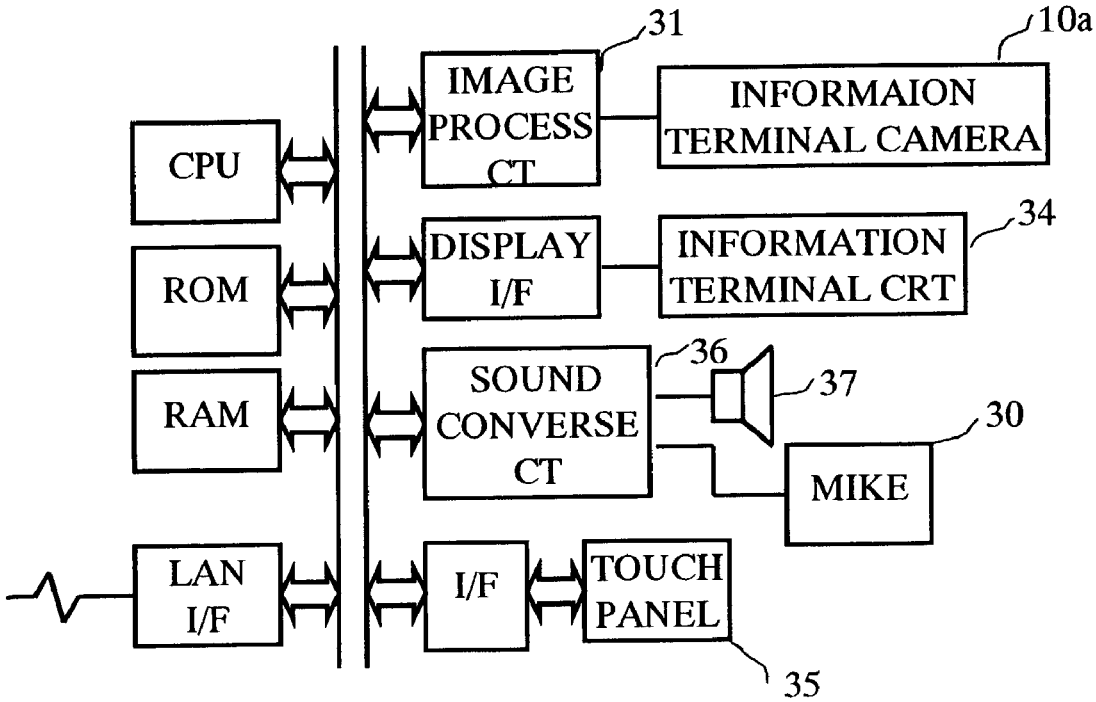
FIG. 8 is a configuration diagram of an information terminal 10 provided for the center system in FIG. 4.

FIG. 8 is a configuration diagram of the information terminal 10 provided in the center system in FIG. 4.

The information terminal 10 is simpler in configuration as compared with the information terminal shown in FIG. 5, for the reason that this information terminal 10 has the console 25 endowed with more functions. The information terminal 10 as used in the center system is provided with the information terminal camera 10*a* and the microphone 30, such that bowlers' face images or voices can be taken therein. Further, the information terminal 10 interfaces with bowlers through the information terminal CRT 34 and the touch panel 35 provided on display screen of the CRT 34. The speaker 37 outputs to bowlers sound included in multimedia information.

Figure 9:
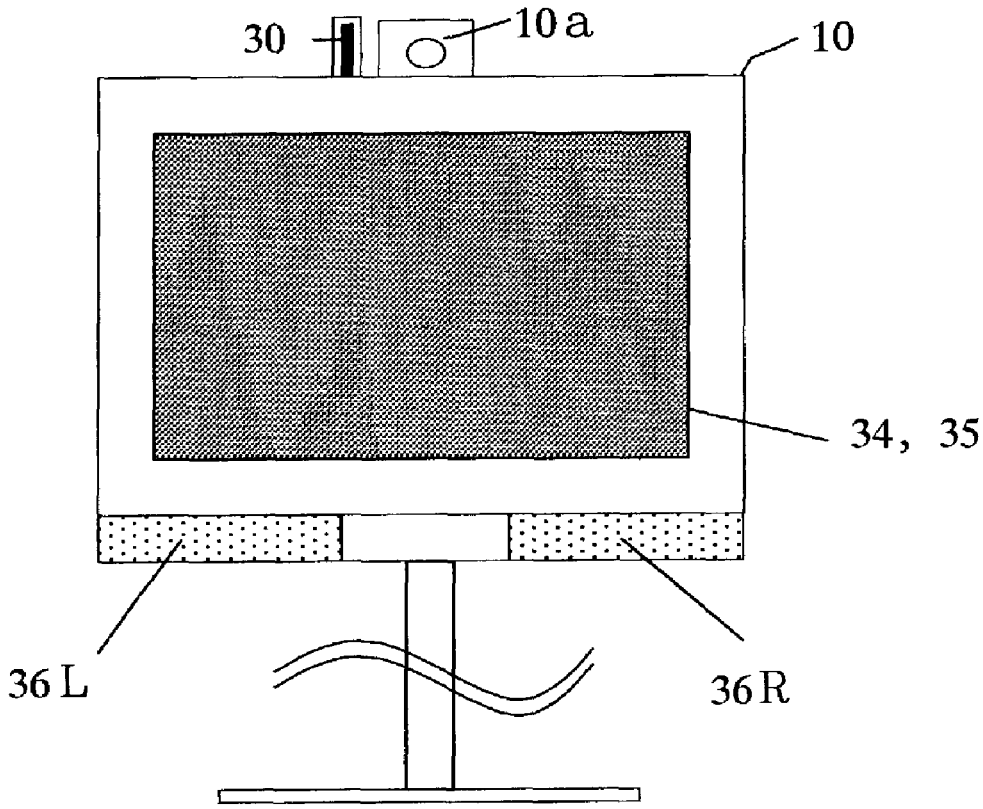
FIG. 9 is a front view of the information terminal 10.

FIG. 9 is a front view of the information terminal 10.

The information terminal camera 10*a* consisting of a CCD camera is for taking bowlers' face images, mounted at the center on the top surface of the information terminal 10. The microphone 30 is for taking in bowlers' voices, located beside the camera 10*a*. The information terminal CRT 34 consists of a LCD monitor, with the touchpanel 35 provided on the monitor surface thereof. At the bottom of the information terminal 10, a speaker 36L is mounted on the left and a speaker 36R on the right.

Automatic settlement of expenses regarding bowling games is made in the following manners.

(A) Settlement for a regular game using the Internet: In a case of a bowling game held using the Internet, a certain amount out of game rate is charged to each bowling center as a charge for using the data management center. Depending on systems, it is also possible to adopt a common point system, a point system common to all bowling centers wherein a bowler is given a premium in accordance with the bowler's payments for bowling games, the premium being the number of points. When the common point system is adopted, a certain amount is additionally charged as a temporary deposit to each bowling center where the system is adopted.

Described below is an example of this type of settlement. The following is a settlement example in bowling centers located in Japan.

EXAMPLE (A-1)

Game rate is set to ¥500. There were ten games held in a bowling center A, six in a bowling center B, and eight in a bowling center C.

The charge for using the data management center is set fixedly to ten percent of the game rate.

The common point system is adopted in the bowling centers A and B, wherein the number of point given to a bowler is set to one point per game and the deposit is set to ¥30 per point.

Figure 11:
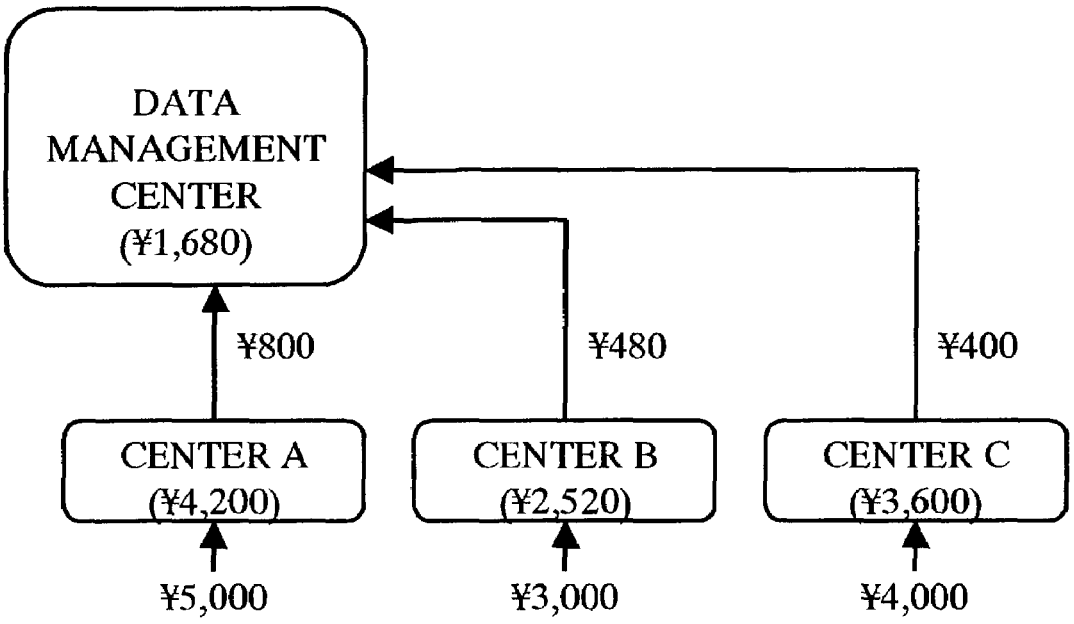
FIG. 11 illustrates money flow in the example shown in FIG. 10.

FIG. 10 shows the example of settlement based on the above. More specifically, the bowling centers A, B, and C are charged ¥800, ¥480, and ¥400 respectively by the data management center. FIG. 11 illustrates money flow in this case.

The settlement is made at regular periods. In a case where the data management center is connected to banks, in addition, inter-account settlement is made between the accounts of the data management center and each bowling center. Furthermore, when a bowler pays by credit card or the like, inter-account settlement is made automatically among the accounts including the bowler's.

(B) Settlement for a tournament or competition using the Internet (with premium offer):

In a case of a game held using the Internet (a tournament, competition, or the like), a certain amount out of game rate is charged to each bowling center as a charge for using the data management center. Costs of premiums are also settled and charged to each bowling center by the data management center. Described below is an example of this type of settlement made in bowling centers located in Japan.

EXAMPLE (B-1)

Participation fee in a tournament or competition is set to ¥5,000.

Participants in the game are sixteen people in a bowling center A, twenty people in a bowling center B, and eighteen people in a bowling center C.

The charge for using the data management center is set fixedly to ten percent of the participation fee, and the cost of premiums is set to fifteen percent of the participation fee.

The example of settlement based on the above is as shown in FIG. 12.

More specifically, the bowling centers A, B, and C are charged ¥20,000, ¥25,000, and ¥22,500 respectively by the data management center, as shown in FIG. 12.

Figure 13:
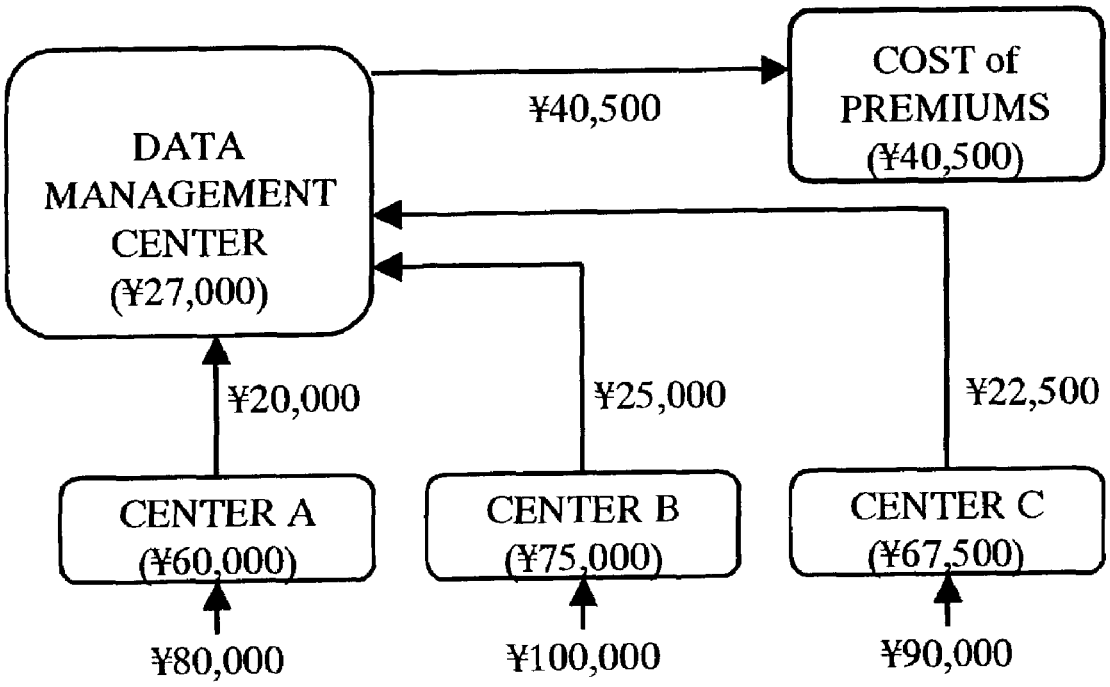
FIG. 13 illustrates money flow in the example shown in FIG. 12.

FIG. 13 illustrates money flow in this case.

(C) Lump-sum settlement for a game using the Internet:

In a case of a game using the Internet (a Net match, a matchup, or the like between staff groups of the head and branch offices of a company), a certain amount out of game rate is charged to each bowling center as a charge for using the data management center. Payment is also made from a bowling center which makes settlement in a lump sum payment, to bowling centers which do not. Described below is an example of this type of settlement for a game to be held in Japan.

EXAMPLE (C-1)

Participation fee in a tournament or competition is set to ¥5,000.

Participants in the game are sixteen people in a bowling center A, twenty people in a bowling center B, and eighteen people in a bowling center C.

The charge for using the data management center is set fixedly to ten percent of the participation fee and settled in a lump sum payment by the bowling center A.

The example of settlement based on the above is as shown in FIG. 14.

Figure 15:
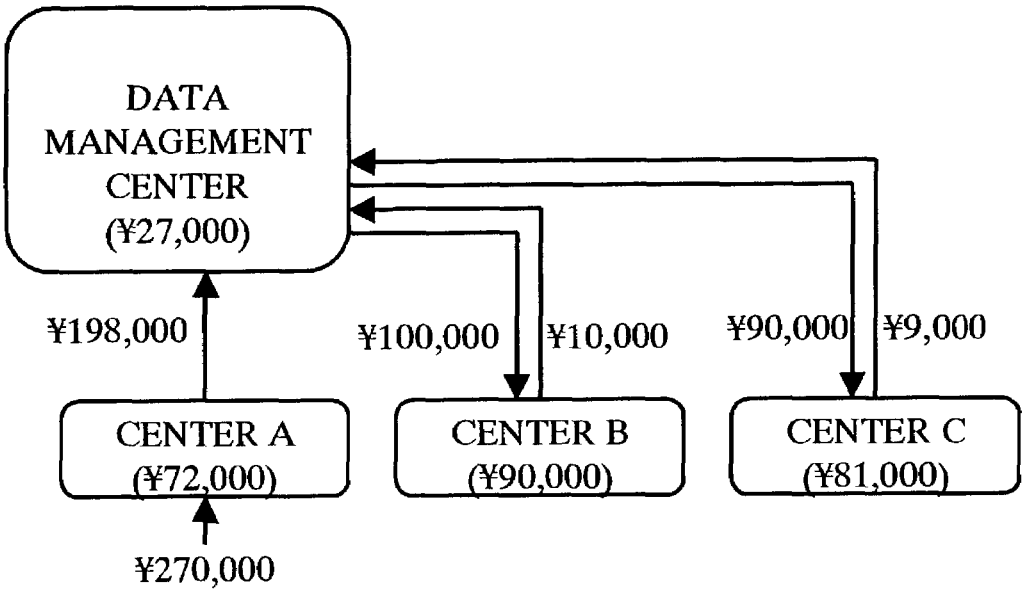
FIG. 15 illustrates money flow in the example shown in FIG. 14.

More specifically, the bowling centers A, B, and C incur payments of ¥198,000, −¥90,000, and −¥81,000 respectively, to the data management center. FIG. 15 illustrates money flow in this case.

(D) Settlement for revenues from advertising using the Internet:

In a case of advertising by use of the Internet, a certain amount is deducted from advertising revenues as a charge for using the data management center, and the remainder is paid to each bowling center at a certain rate (as of the number of times when advertisements are displayed, the number of information terminals provided, etc.). Described below is an example of this type of settlement made for a game held in Japan.

EXAMPLE (D-1)

Advertisement charge is set to ¥5 per display and charged to the advertiser. Dividend to each bowling center reflects the number of times an advertisement is displayed.

The advertisement is displayed 6,000 times in a bowling center A, 10,000 times in a bowling center B, and 12,000 times in a bowling center C.

A charge for using the data management center is set fixedly to ten percent of the advertisement charge.

FIG. 16 shows the example of settlement made in this case.

Figure 17:
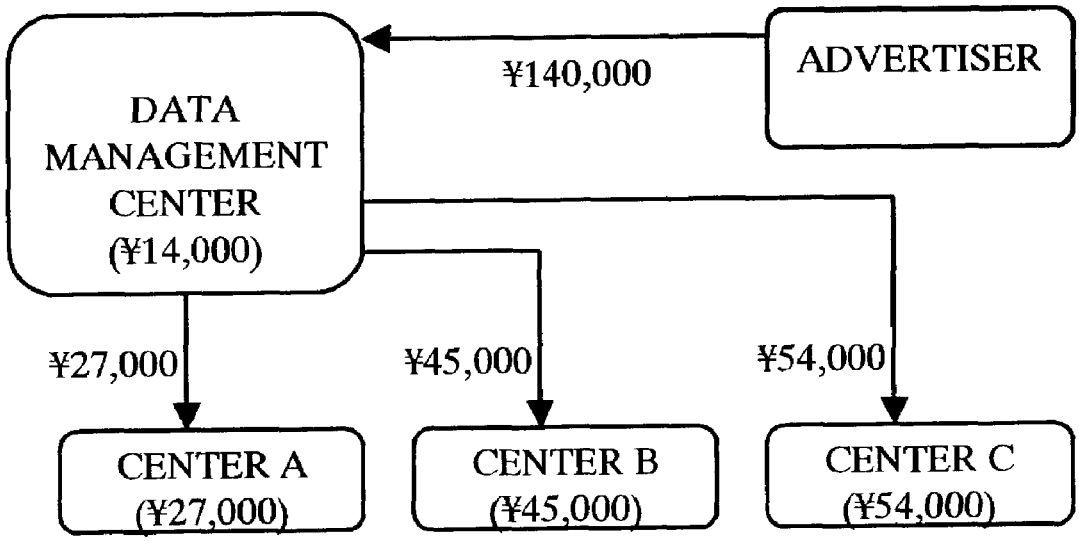
FIG. 17 illustrates money flow in the example shown in FIG. 16.

More specifically, the data management center incurs payments of ¥27,000, ¥45,000, and ¥54,000, respectively to the bowling center A, B, and C, and the charge for using the data management center is ¥14,000. As a consequence, the charge to the advertiser is ¥140,000. FIG. 17 illustrates money flow in this case.

(E) Settlement by use of multinetting:

Settlement regarding games and advertisements using the Internet is automatically made by the data management center by use of multinetting. More specifically, money is transferred between accounts which each bowling center and the data management center have at financial institutions.

EXAMPLE (E-1)

The contents of settlement as in the aforementioned (A) through (D) are settled:

(A-1): the content of settlement as shown in FIG. 10;

(B-1): the content of settlement as shown in FIG. 12;

(C-1): the content of settlement as shown in FIG. 14;

(D-1): the content of settlement as shown in FIG. 16.

Settlement of the above results in payments balance among the bowling centers and the data management center, as shown in FIG. 18.

Figure 19:
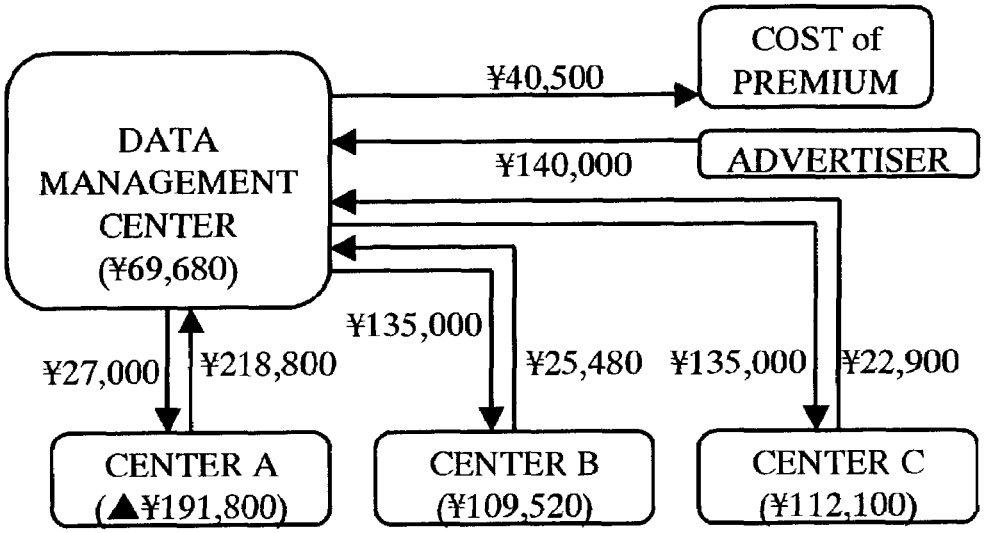
FIG. 19 illustrates receipts and disbursements accounts balanced among the respective bowling centers and the data management center.

FIG. 19 shows money flow in this case.

As described above, the expenses in relation to bowling games (including advertisement charge) is automatically settled in the data management center, such that the cost of running the data management center can be apportioned equally among bowling centers. In addition, the processing of such settlement can be carried out quickly and accurately. Settlement in bank accounts can be also facilitated by connecting the data management center with banks. Inter-account settlement can be made easily among the bank accounts of respective bowlers, bowling centers, and the data management center.

Next described are details about a game when actually held using the aforementioned system.

(Main menu screen display on the information terminal)

FIGS. 20 through 25 show main menu screen display on the information terminal.

Figure 20:
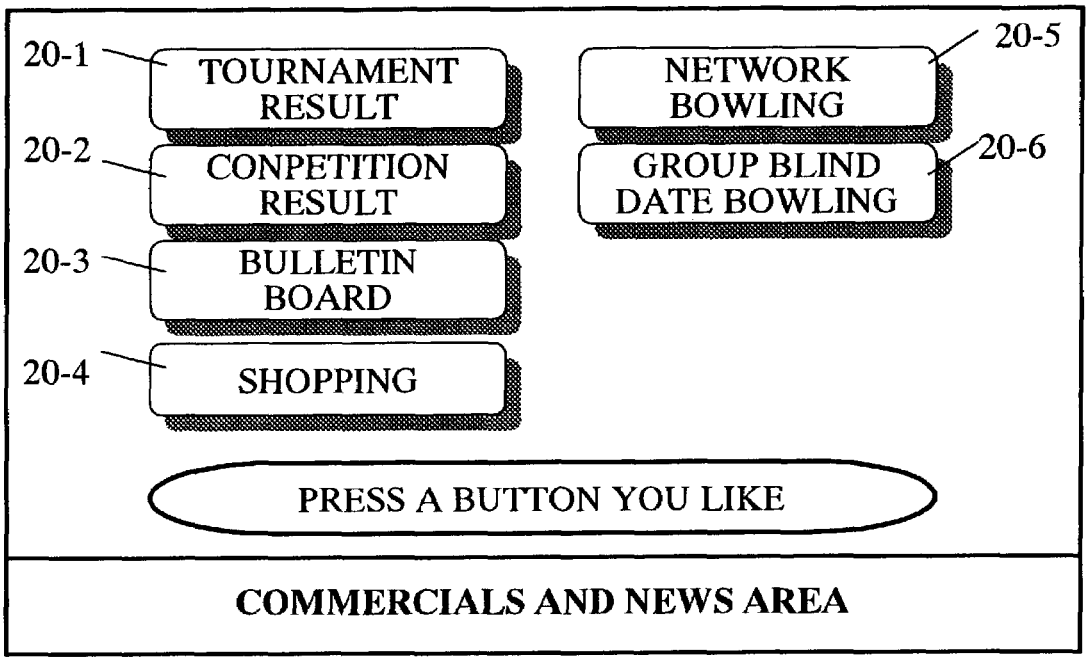
FIGS. 20 through 25 show main menu screen display on the information terminal.

Shown in FIG. 20 is a main menu screen, on which game contents and the like are selected.

In this example, there are six menus in total displayed on the screen: "Tournament Result" 20-1, "Competition Result" 20-2, "The Bulletin Board" 20-3, "Shopping" 20-4, "Network Bowling" 20-5, and "Group Blind Date Bowling" 20-6.

The bottom area on the screen is for displaying commercials and news.

Figure 21:
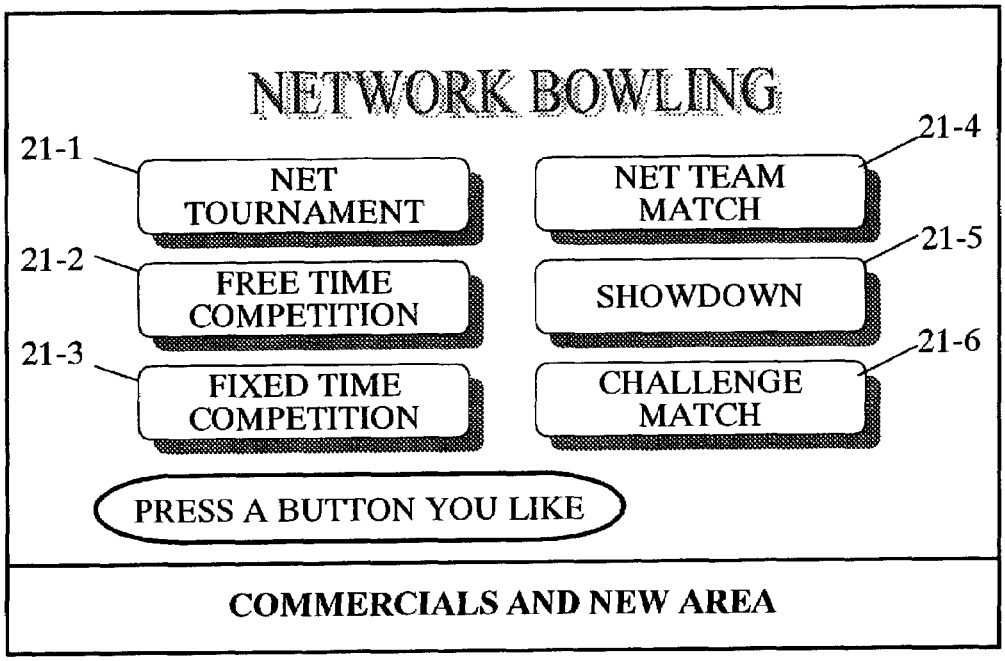

FIG. 21 shows a screen displayed when a "Network Bowling" button 20-5 is pressed. There are six types of network bowling game: "Net Tournament" 21-1, "Free Time Competition" 21-2, "Fixed Time Competition" 21-3, "Net Team Match" 21-4, "Showdown" 21-5, and "Challenge Match" 21-6.

Figure 22:
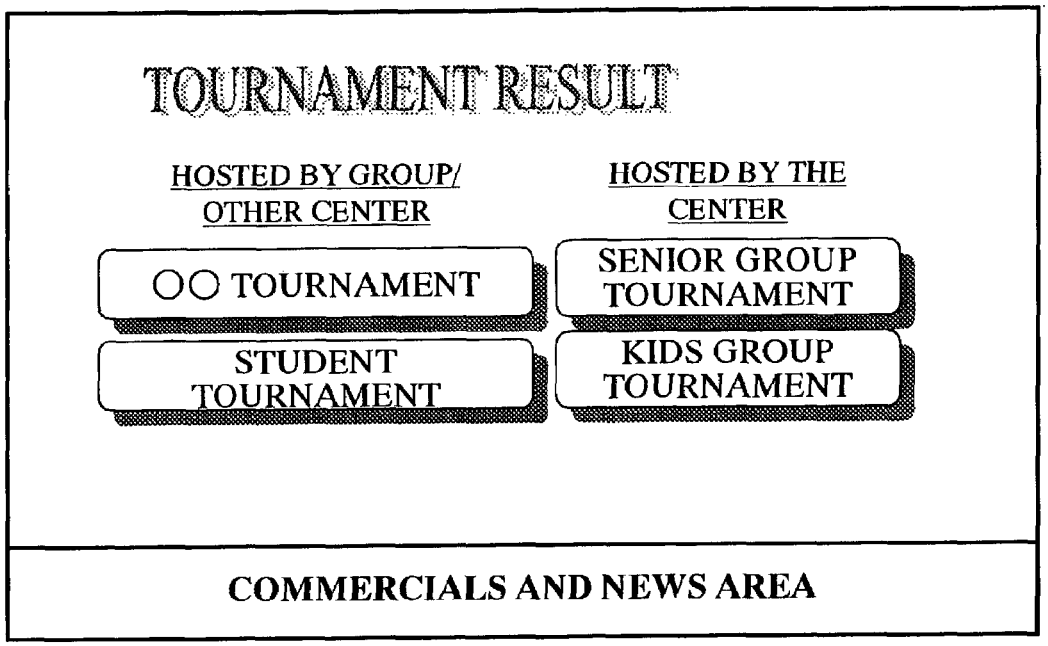

FIG. 22 shows a screen for "Tournament Result".

Figure 23:
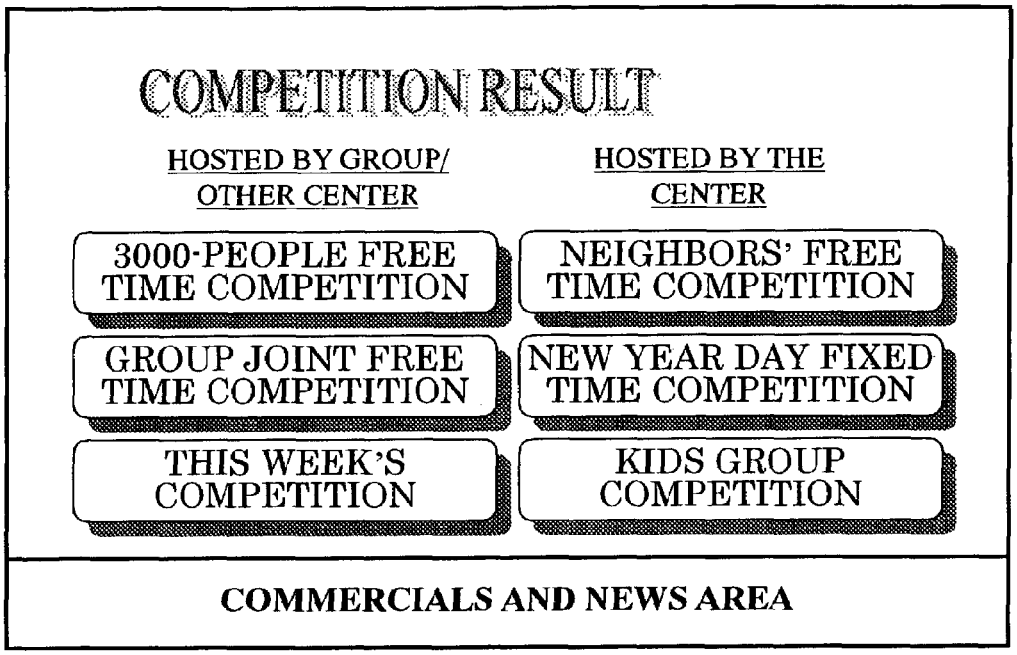

FIG. 23 shows a screen for "Competition Result".

Figure 24:
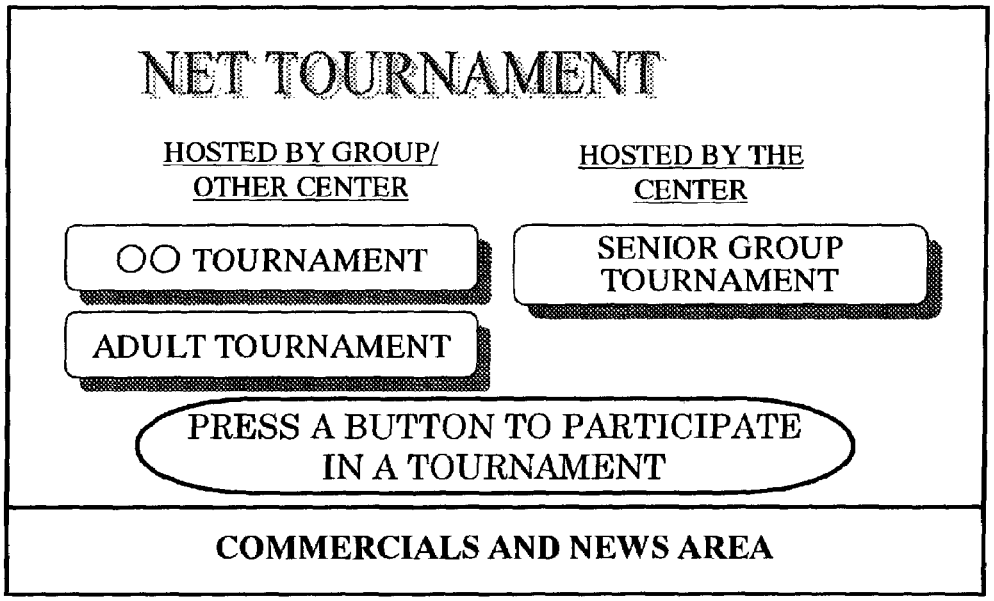

FIG. 24 shows a screen displayed when a "Net Tournament" button 21-1 is pressed.

Figure 25:
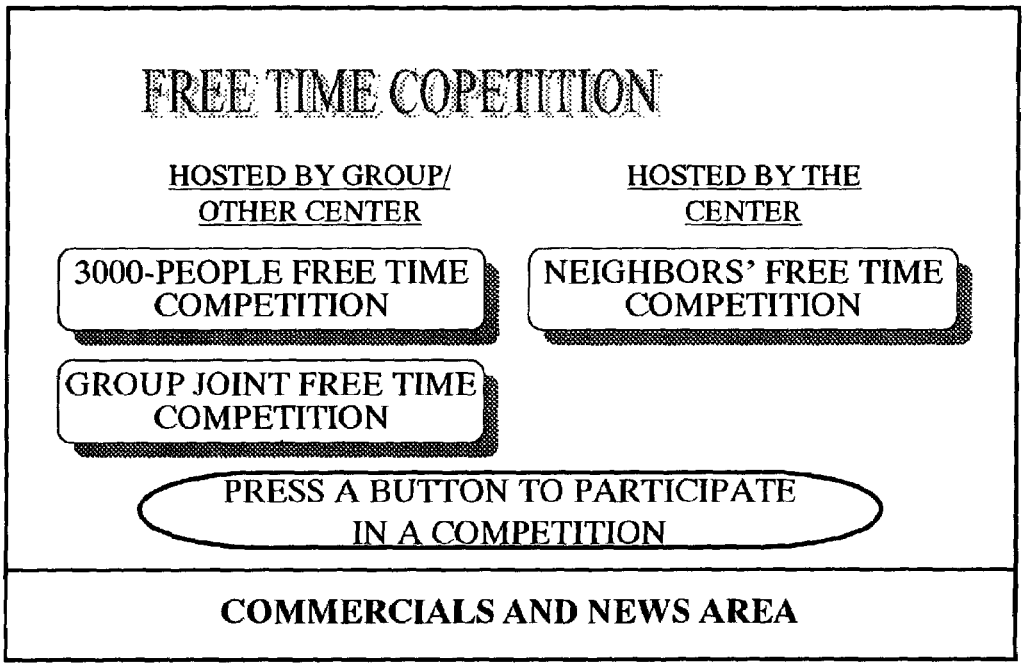

FIG. 25 shows a screen displayed when a "Free Time Competition" button 21-2 is pressed.

Figure 26:
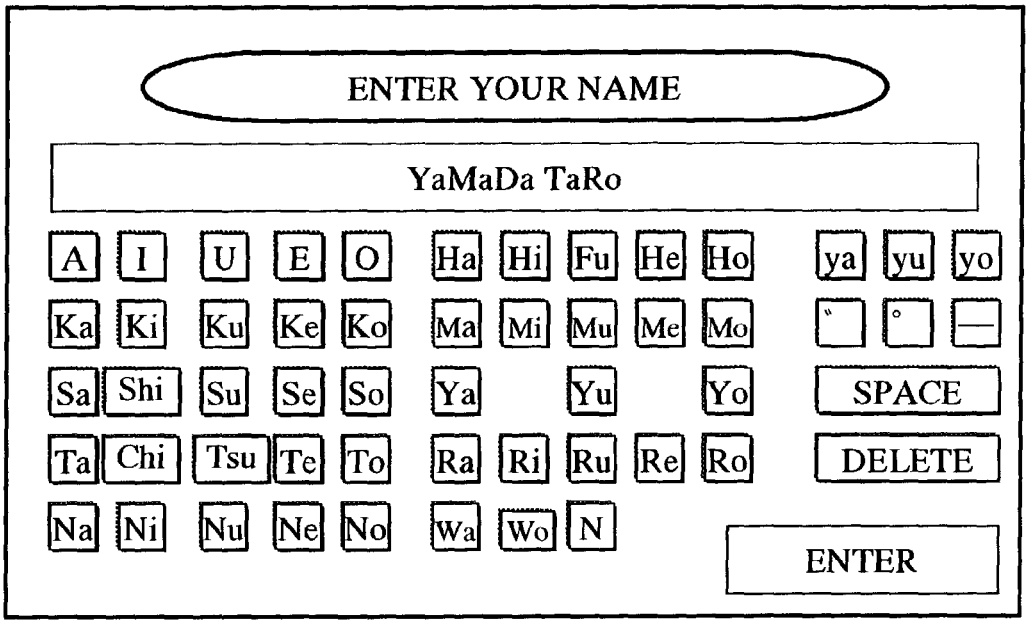
FIGS. 26 through 28 show screen display for registering information such as a bowler's profile.
Figure 27:
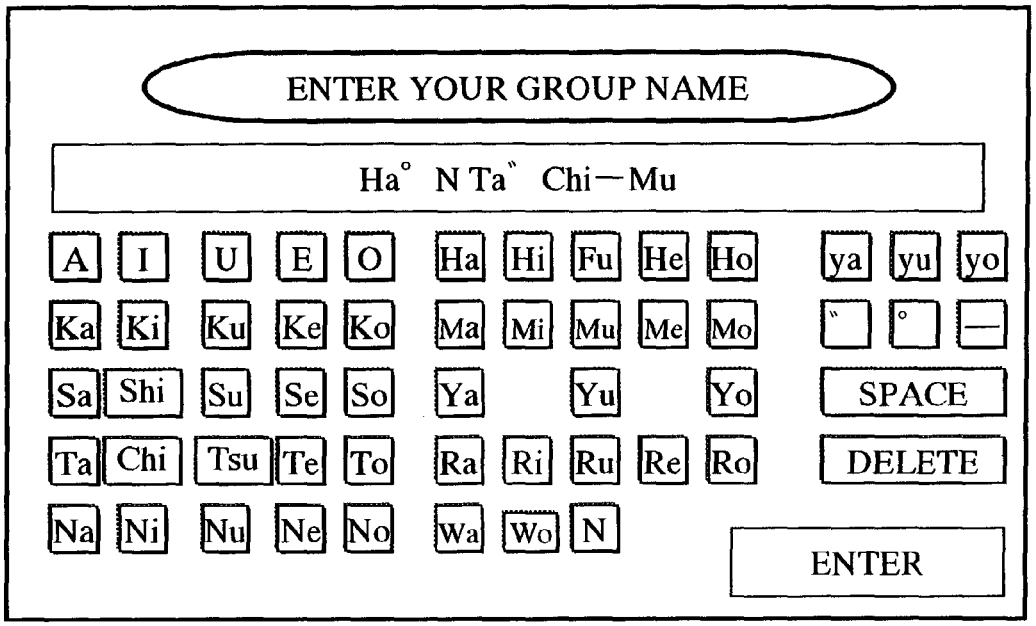
Figure 28:
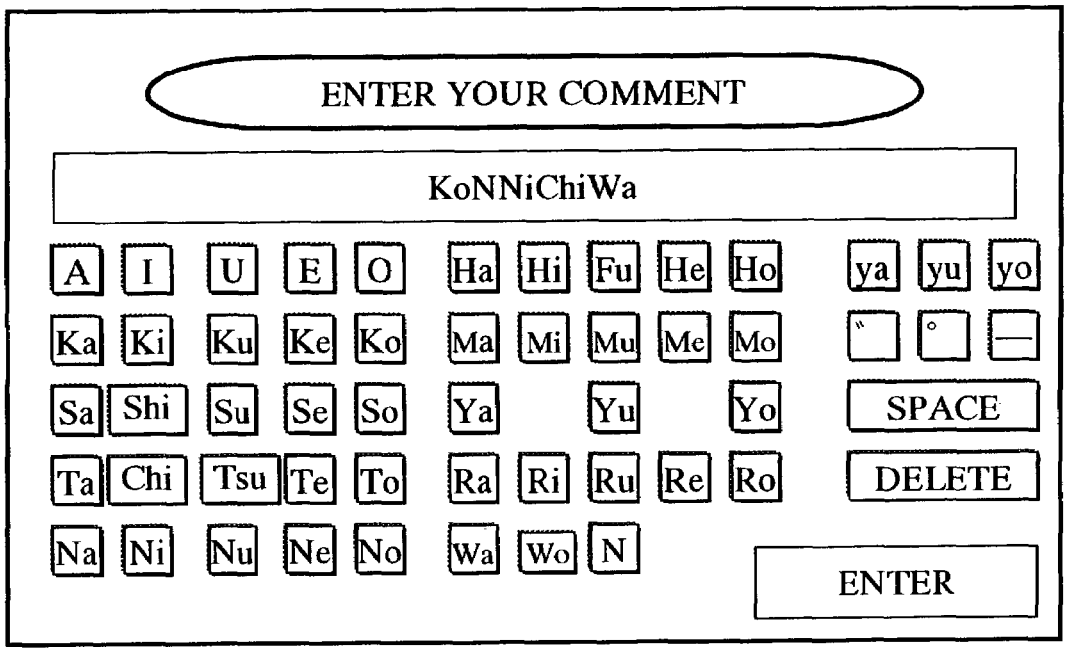

FIGS. 26 through 28 show screens for registering information such as a bowler's profile. FIG. 26 illustrates a screen for entering a bowler's name, FIG. 27 illustrates a screen for entering the name of a group to which a bowler belongs, and FIG. 28 illustrates a screen for entering a bowler's messages. Shown in the Figures are examples of screens displayed in a case where the bowling system is employed in a bowling center located in Japan. If the system is employed in a bowling center located in an English-speaking country, the entry keys on the screens will be alphabet ones.

Figure 29:
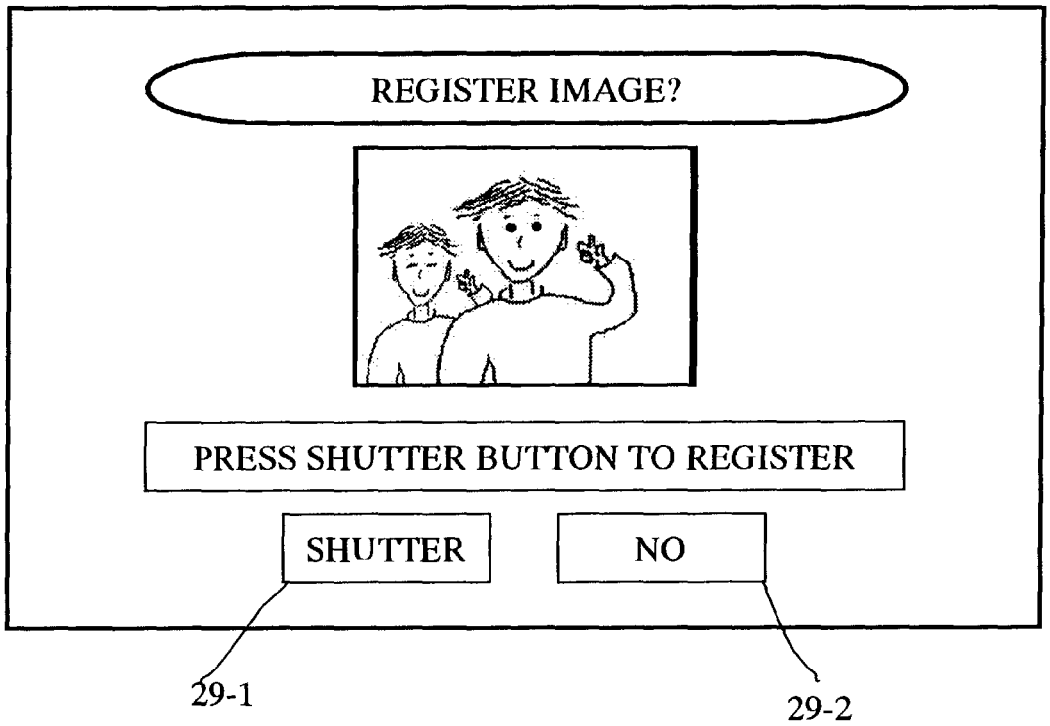
FIG. 29 shows screen display for registering images.

FIG. 29 shows a screen for registering images. A shutter button 29-1 is pressed for operating the information terminal camera 10*a*, such that a bowler's image, still or moving, is taken and registered as shown in the Figure. A button 29-2 is pressed if a bowler intends not to register the bowler's image.

Figure 30:
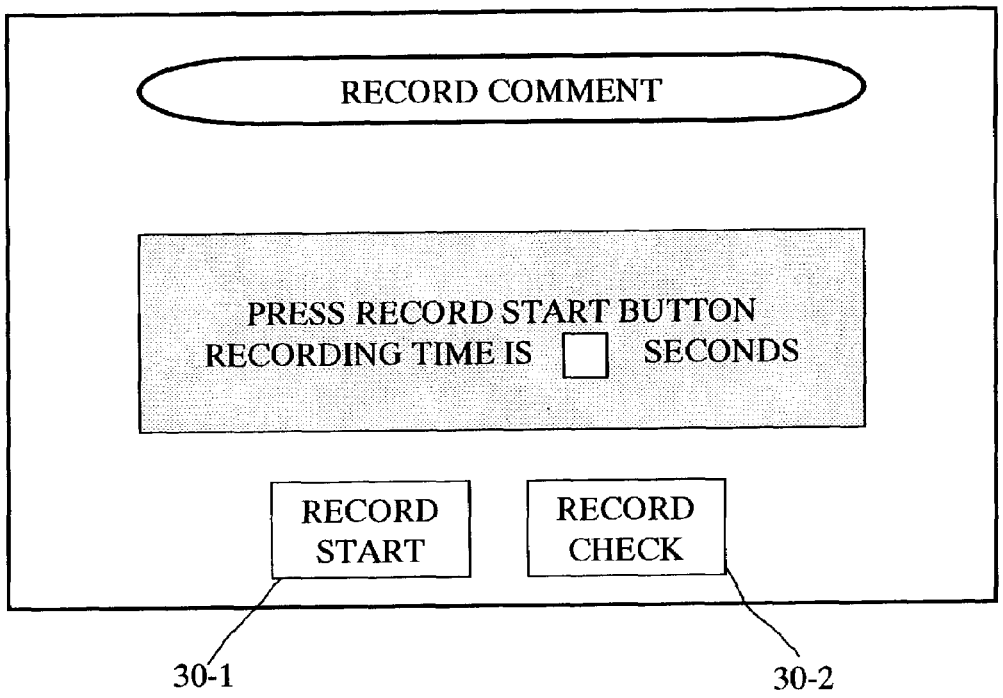
FIG. 30 shows screen display for registering a bowler's voices as the bowler's comment.

FIG. 30 illustrates a screen for registering a bowler's voices. A record start button 30-1 is pressed for setting the information terminal 10 in a recordable state, in which what a bowler speaks at the microphone 30 is recorded. A record check button 30-2 is pressed for playing back the recorded sound.

The multimedia information which is registered in the foregoing FIGS. 26 through 30 is registered as communication information on the multimedia bulletin board MM (shown in FIG. 1) in the data management center.

Next described are details of respective games.

(Net Tournament)

Figure 31:
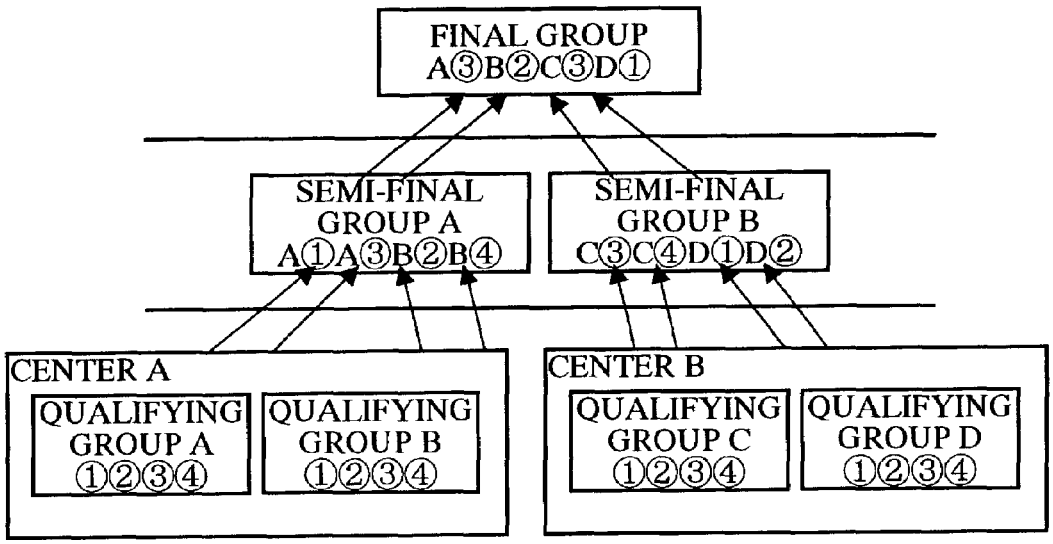
FIG. 31 is a block diagram showing an image of a network tournament.

In this Net tournament bowlers, divided into some groups, play games within each of the groups to be narrowed down by selection or the like, and the survivors play a final game. Shown in FIG. 31 is an image of the Net tournament.

Described below is the Net tournament based on the example shown in FIG. 31.

In a bowling center A, there are qualifying games held in qualifying groups A and B respectively.

In a bowling center B, there are qualifying games held in qualifying groups C and D respectively. Ranking shall be determined by a point system.

An implementation example of the Net tournament is described below with reference to a screen display of an overhead CRT in the bowling center A.

Figure 33:
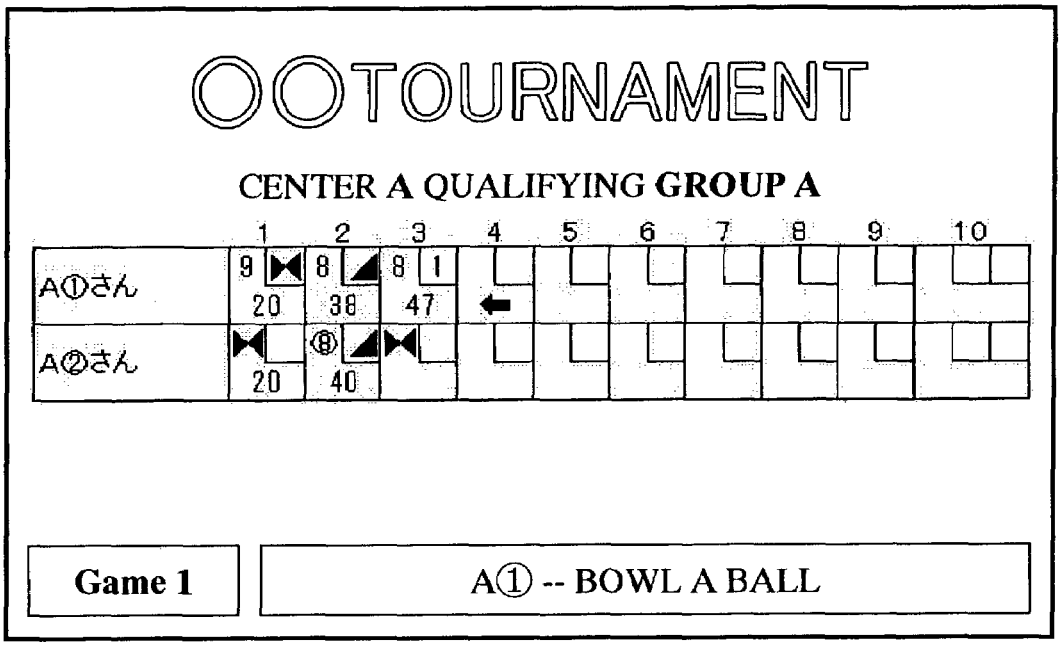
FIG. 33 shows another example of overhead screen display.
Figure 34:
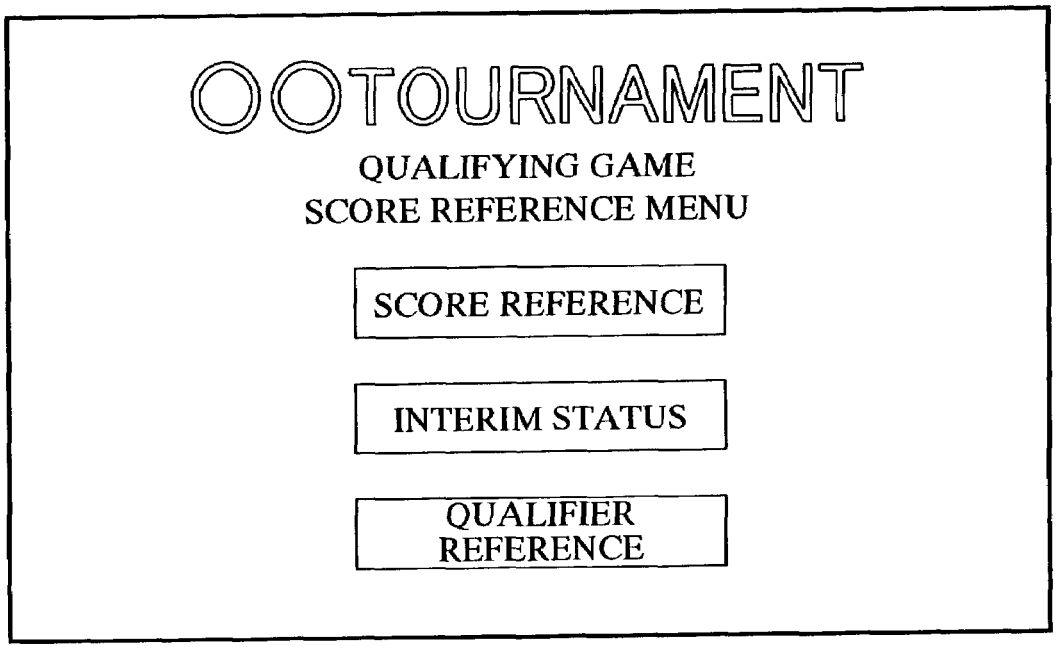
Figure 35:
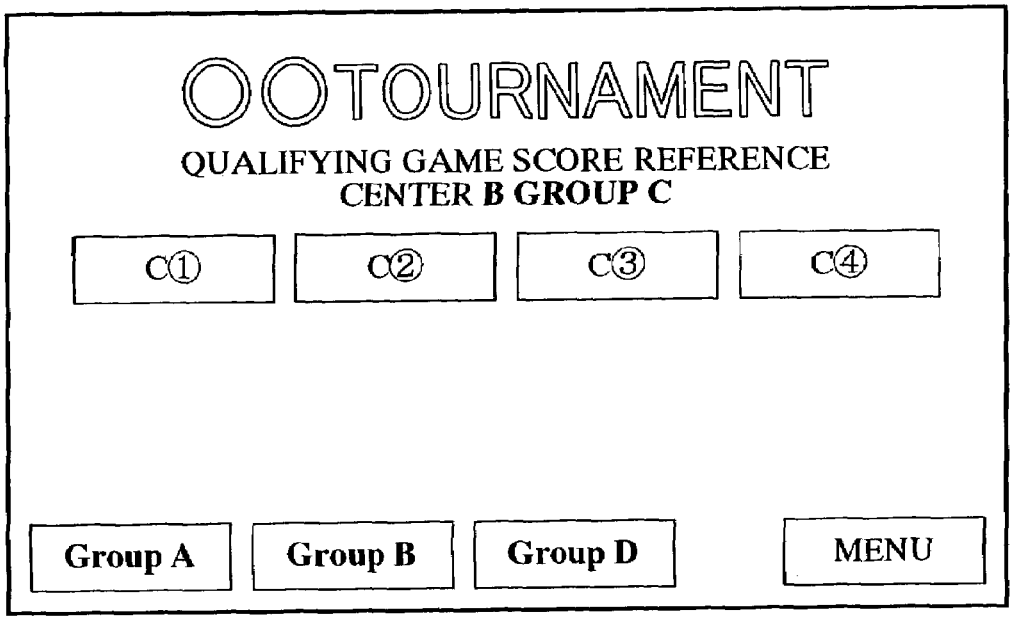
Figure 36:
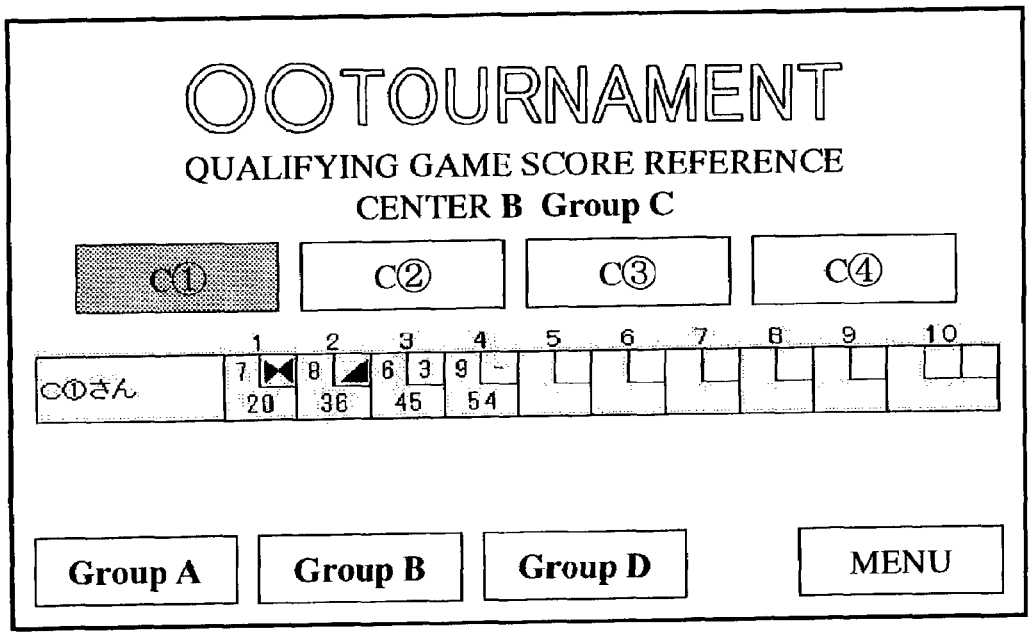

Before the tournament is started, necessary items for the tournament are registered with the data management center. In each of bowling centers where the tournament is held, the tournament is started within a predetermined time period. On request for the game start, the data which has been registered with the data management center in advance is referred to and information on opponents and the like is displayed on the screen of an overhead CRT, via a center server (the center server 22 in FIG. 22). FIG. 32 shows an overhead display screen (the screen displayed on the overhead CRT) displayed at the time. With the start of the game, the screen is switched to a score display screen (shown in FIG. 33). On each information terminal in each bowling center, score status of each bowler can be referred to, with a standby menu displayed on which a bowler operates for reference. To refer to the score of Bowler C①, a bowler presses a score reference button shown in FIG. 34. Then the display screen is switched to a display screen shown in FIG. 35. Here the bowler presses a button for Bowler C①, and there appears a screen shown in FIG. 36, on which the score of Bowler C① is displayed. An interim status button is pressed in FIG. 34, and then there appears a display screen shown in FIG. 37, on condition that all the bowlers have finished bowling for an entire game in game one. FIG. 37 illustrates interim status of the qualifying group D in the bowling center B.

When the game is over, all game information is processed in the data management center, and the result is distributed to each bowling center and displayed on the screen of an overhead CRT which is connected to each information terminal. At the time a bowler can refer to qualifiers on the screen if the bowler would like to. In addition, a ranking list for the game (game score included) is stored on the bulletin board in the data management center and therefore can be referred to in real time from each bowling center.

Figure 38:
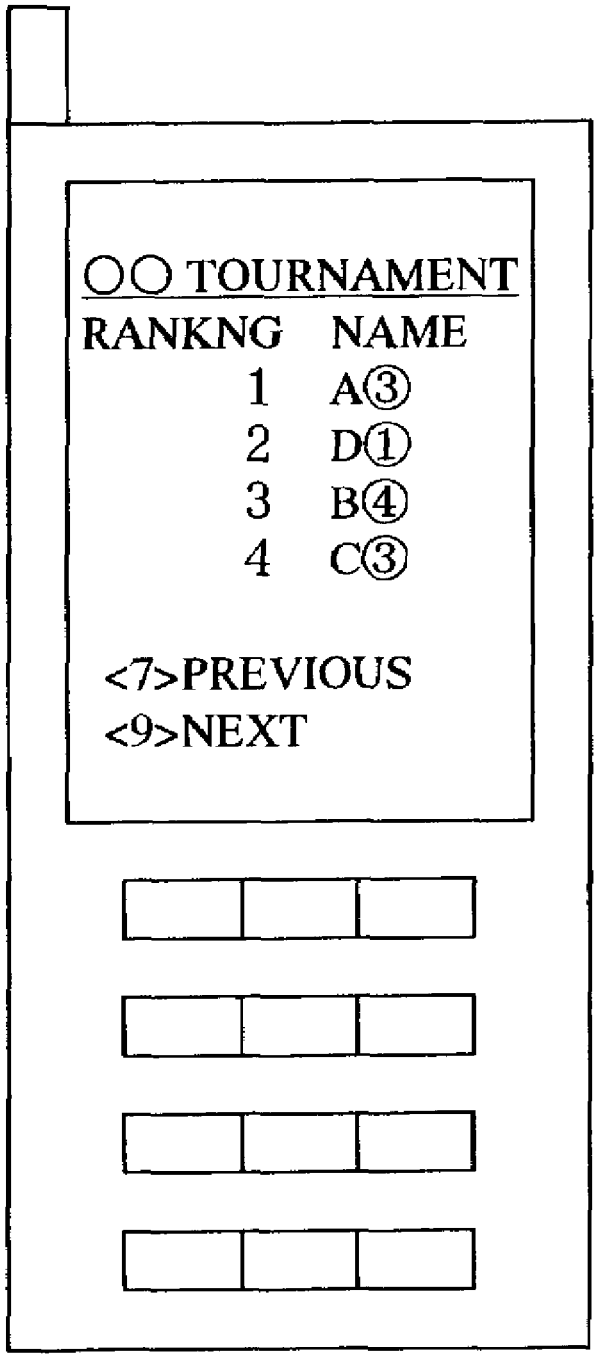
FIG. 38 shows a communication terminal.

These procedures are performed repeatedly until a final game where a champion, a vice champion, and the like are determined. The final result of the tournament is posted on the bulletin board in the data management center in real time. Consequently, the interim and final results of past tournaments are available at any time to those who have access right to the bulletin board, and can also be confirmed on a display screen of a communications terminal (a terminal such as a cellular phone), for example, as shown in FIG. 38. Illustrated in FIG. 39 is a display screen on the information terminal 10, showing the result of a past tournament which is retrieved by accessing the bulletin board. The access right to the bulletin board can be given either to participating bowlers or particular members only, or to all those who have access to the Internet.

Figure 40:
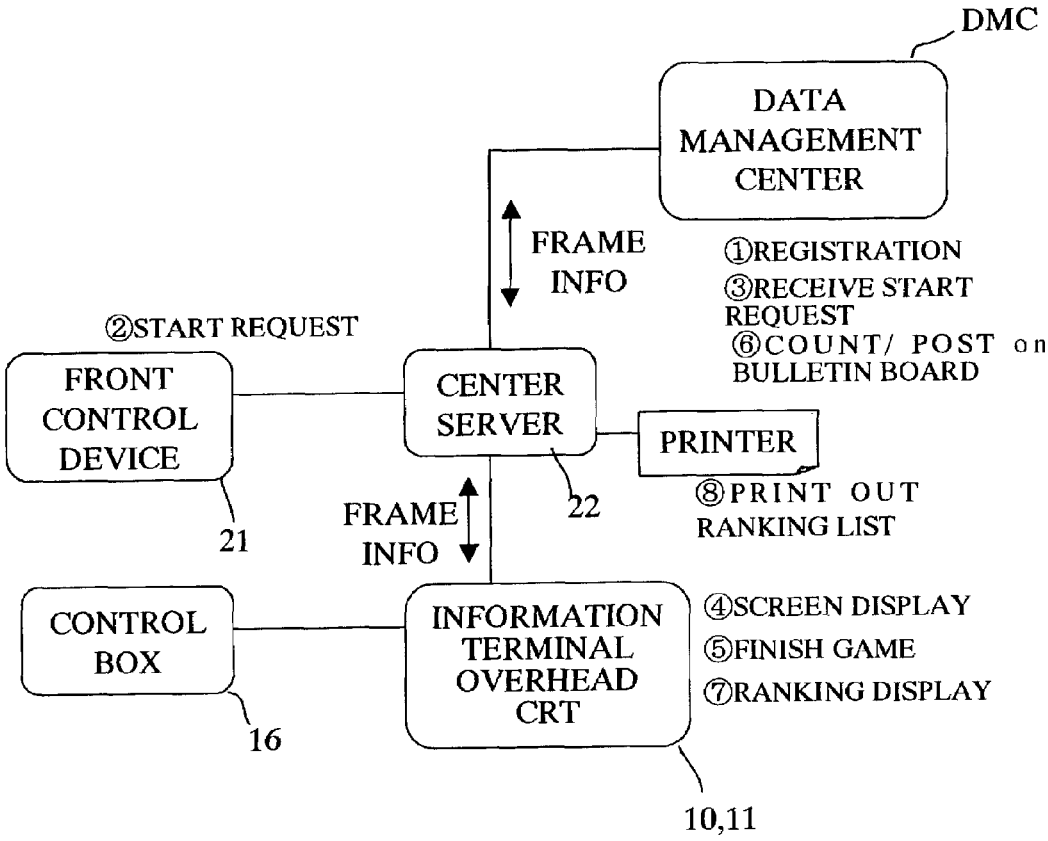
FIG. 40 is a block diagram showing a main flow of implementation of a network tournament.

Shown in FIG. 40 is a main flow of implementation of a Net tournament, wherein reference numerals ① through ⑧ show functions of respective units. Frame information (frame data) flows between the data management center DMC and the center server 22, and between the center server 22 and the information terminal 10, the overhead CRT 11. The frame information, which is game data per frame, may also be data per bowl.

(Network Competition)

The Network competition falls into free-time and fixed-time competitions, wherein bowlers play prescribed number of games within a predetermined time period, and at the expiration of the period ranking of the bowlers is determined based on their total score including handicaps and the like.

Figure 41:
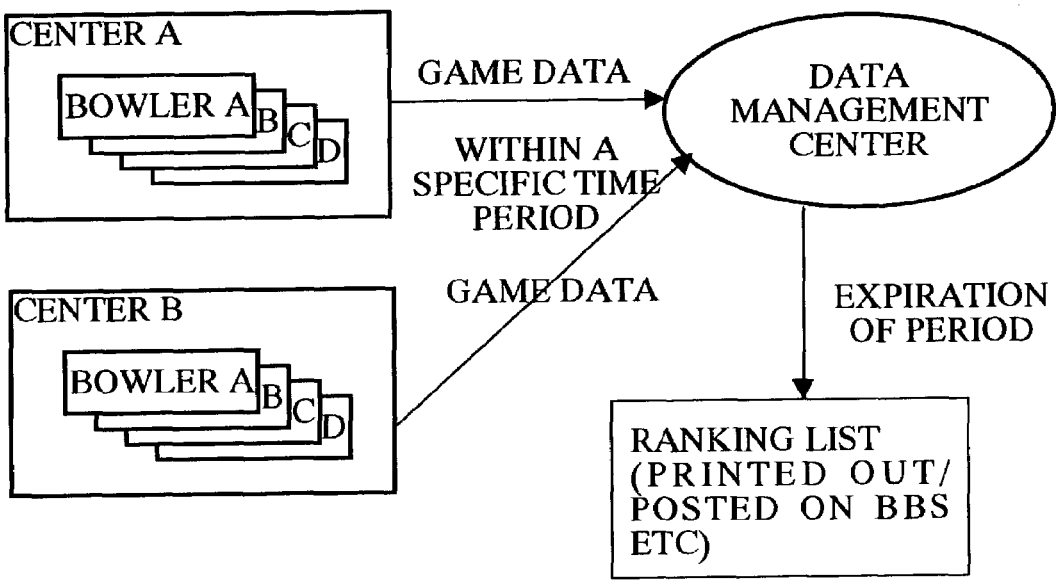
FIG. 41 is a block diagram showing an image of a network competition.

FIG. 41 shows an image of the network competition.

The free-time competition is a competition in which participation is free within a specific time period. The fixed-time competition is a competition with its start time fixed. In the free-time competition, the information terminals have a pre-game-start screen displayed thereon, for confirming a bowler's intention to participate in the competition or explaining the game, and a bowler can participate in the game by indicating on the screen the bowler's intention to participate. If a bowler participates in the competition within a calculation period, the data management center automatically starts to calculate game data of the bowler. A ranking list can be outputted in each bowling center when required. The list is also posted on the bulletin board.

Figure 42:
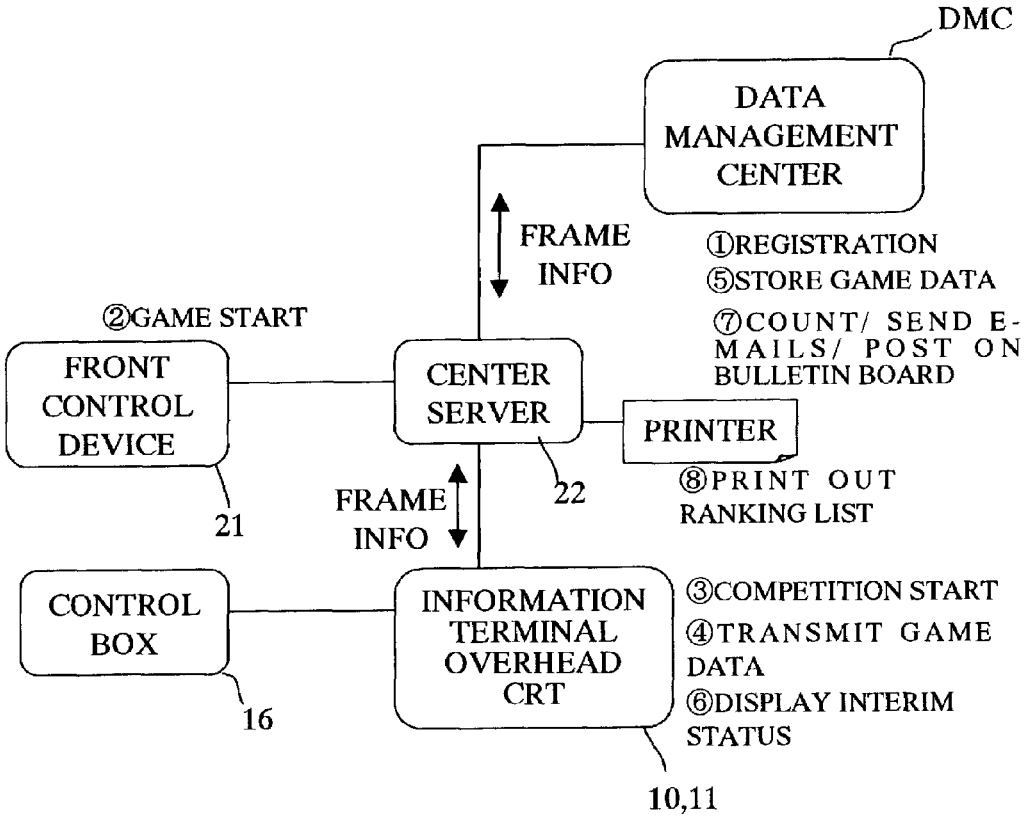
FIG. 42 is a block diagram showing a main flow of implementation of a network competition.

Shown in FIG. 42 is a main flow of implementation of a network competition, wherein reference numerals ① through ⑥ show functions of respective units.

(Challenge Match)

The challenge match is a game in which a bowler plays against past or virtual game information. In accordance with game progress, the center system receives from the data management center game progress information of a bowler and past or virtual game progress information against which the bowler plays, and processes those information.

Figure 43:
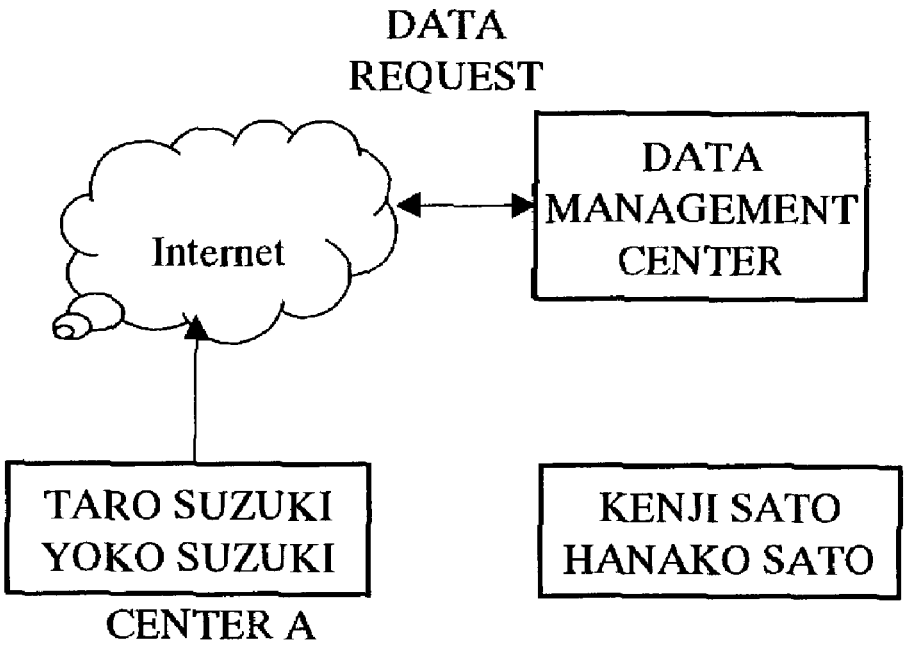
FIG. 43 is a block diagram showing an image of a challenge match.

Shown in FIG. 43 is an image of the challenge match.

A bowler who intends to play a challenge match selects an opponent on the information terminal 10 by use of the bulletin board, in order to play against the past game information of the opponent. Alternatively, the bowler plays against pre-set virtual game information. The result of the match is transmitted to the opposing bowler via the mail server. Described below is a way the challenge match is played.

The following is an example in which "Taro Suzuki" and "Yoko Suzuki" now start to play against past game data of "Kenji Sato" and "Hanako Sato" which has been already registered with the data management center.

Figure 44:
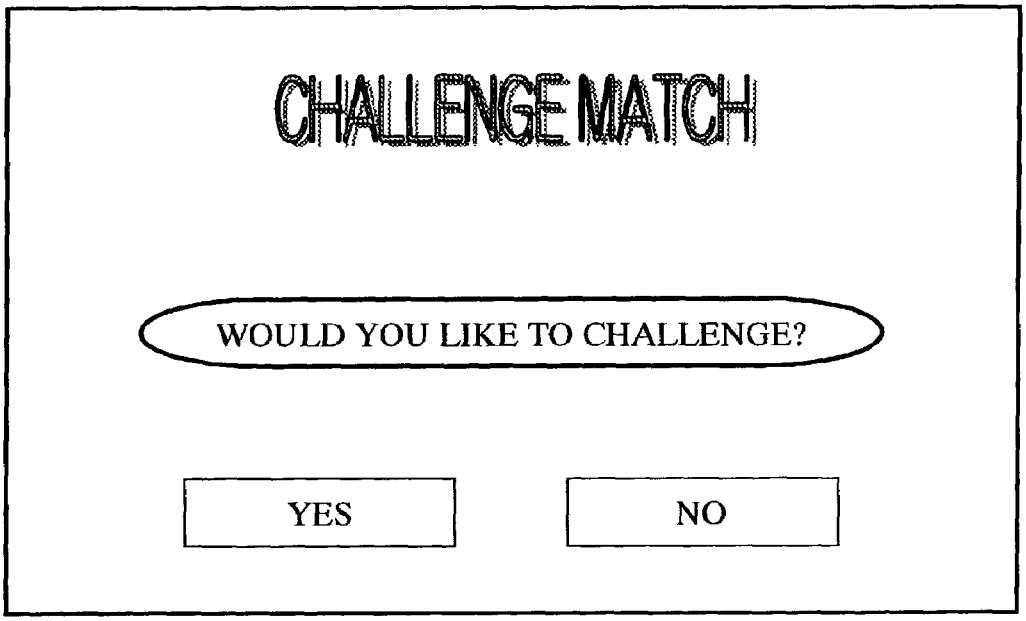
Figure 45:
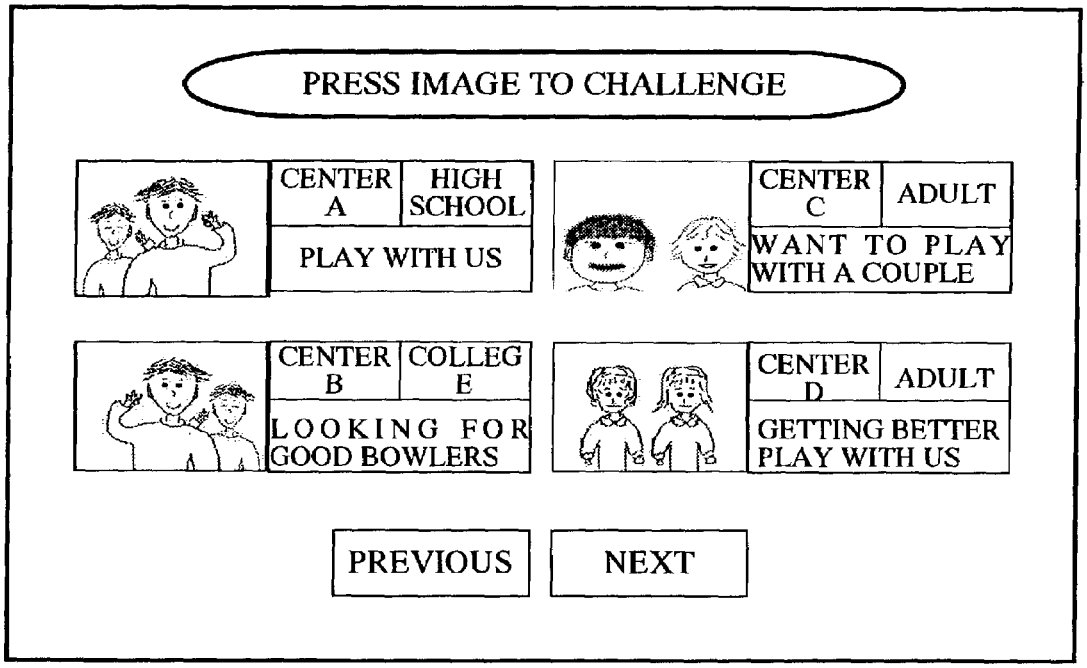
Figure 46:
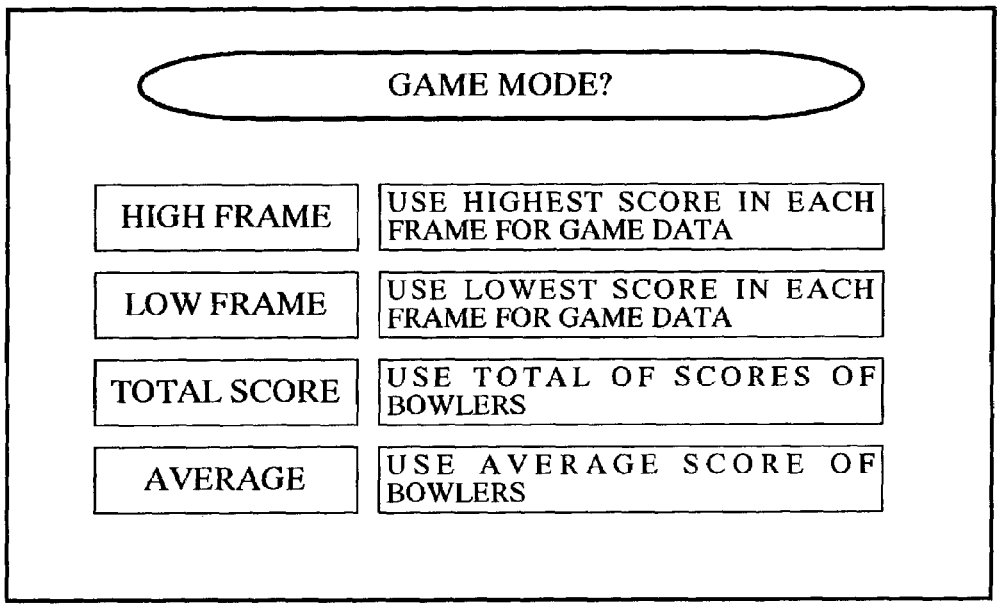

A screen for confirming a bowler's intention to play a challenge match is displayed on the information terminal 10 provided on a lane on which Team "Suzuki" is about to play. Shown in FIG. 44 is the screen. When a "Yes" button is pressed, there appears a screen shown in FIG. 45 for choosing an opponent. As potential opponents displayed at random are teams with the same number of members as in Team "Suzuki" therein, which have been searched out from among past data in the data management center on search conditions that Team "Suzuki" desires. Let us now suppose that Team "Sato" in a bowling center C is chosen as an opposing team. Shown in FIG. 46 is a screen for selecting game modes. Let us suppose that "High Frame" mode is selected here.

Figure 47:
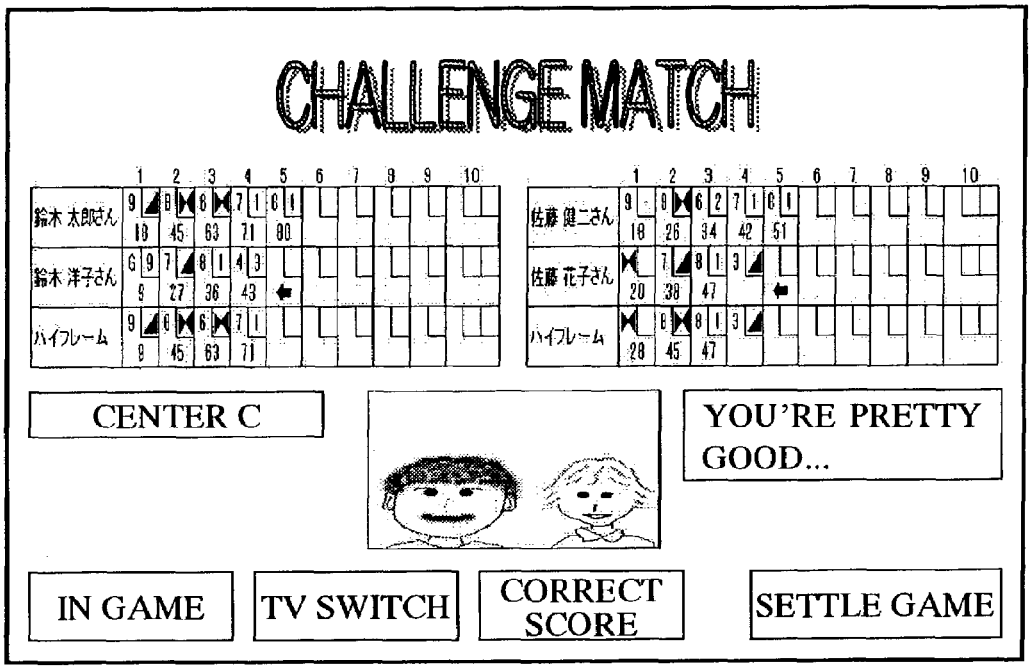
Figure 49:
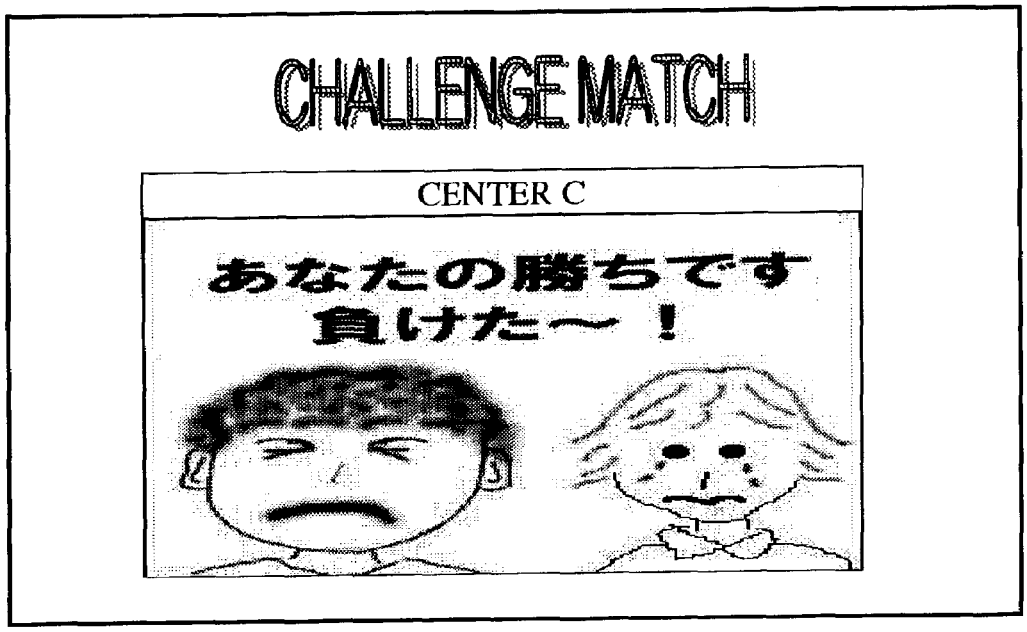

Once the game is started, scores of the members of the opponent team are displayed on the information terminal 10 in each frame (as shown in FIG. 47). For this reason the game progresses as if it were being actually played with Team "Sato" simultaneously. FIG. 48 illustrates an overhead CRT screen display during the game. When the game is over the win-loss result is displayed on the CRT screen, as shown in FIG. 49. The result is further sent to Team "Sato" at the team's e-mail address, for example in such a form as follows:

"Today you had two challengers, with a win and two losses. Team "Suzuki" is waiting for your challenging back."

While another bowler's past game information is used as an opponent in the foregoing example, virtual game information may be used instead of actual past game information. It is possible to highly increase fun of a bowling game by setting game information disguised as a celebrity's or a professional bowler's game information for virtual game information to be used as an opponent.

Figure 50:
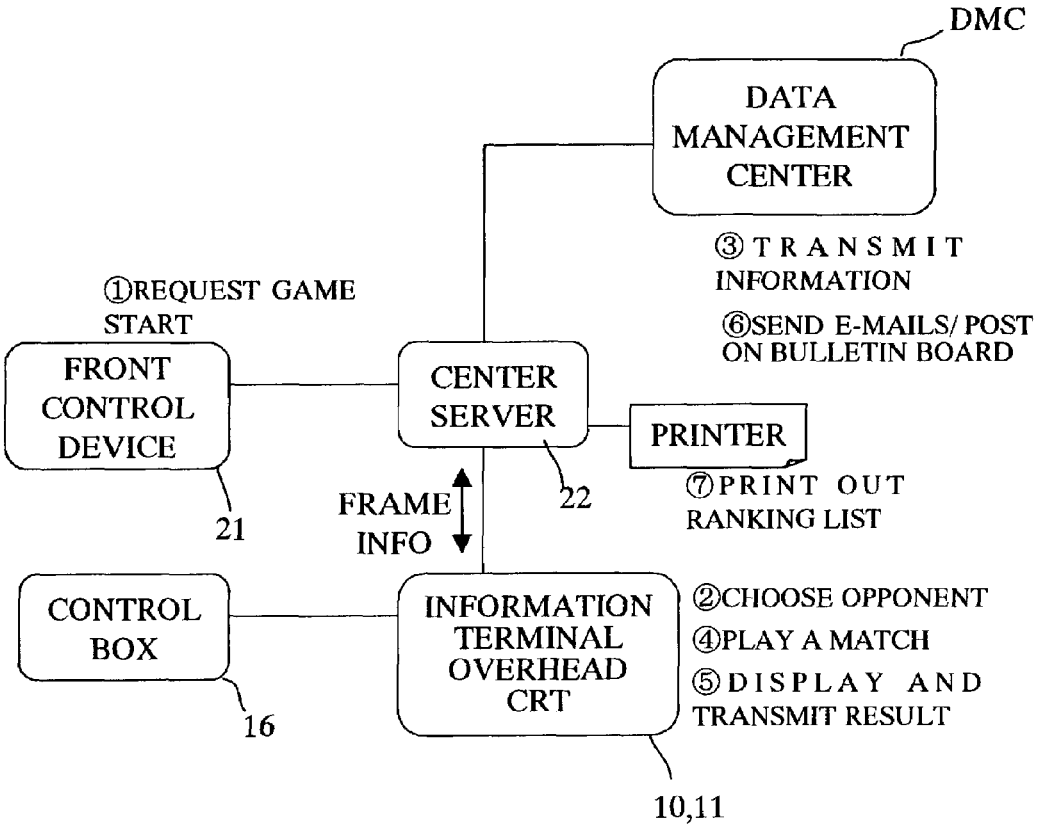
FIG. 50 is a block diagram showing a main flow of implementation of a challenge match.

Shown in FIG. 50 is a main flow of implementation of the challenge match as described above, wherein reference numerals ① through ⑧ show functions of respective units.

In the above-described challenge match, the game progresses as if the opposing team were actually playing the game. This game mode is referred to as virtual mode. Fun of a bowling game highly increases in a game played in the virtual mode.

(Group Blind Date Bowling)

The group blind date bowling game is a type of Net team matches, which is played via a network in particular by a group of men in one bowling center and a group of women in another. Once the group blind date bowling game starts, mutual communication becomes possible through multimedia information including images or voices of bowlers. Dating opportunities are offered spontaneously through this bowling game.

(Net Team Match)

Figure 51:
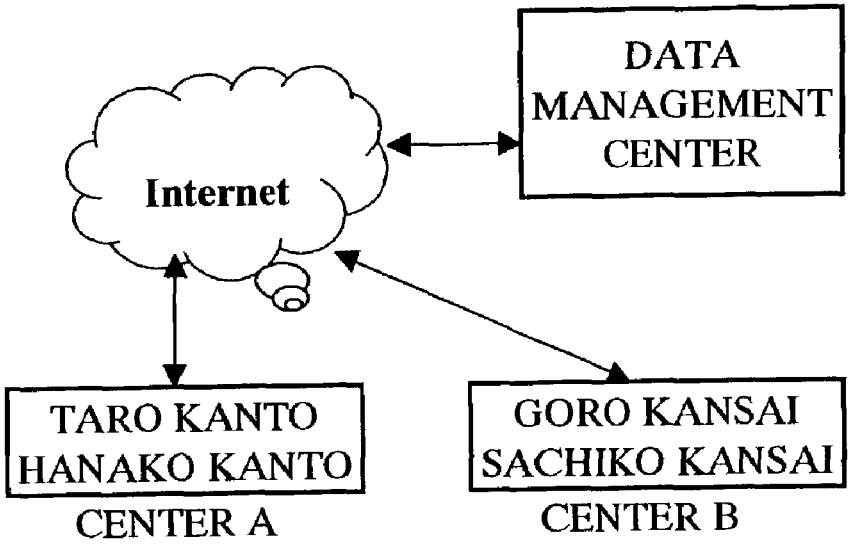
FIG. 51 is a block diagram showing an image of an example of a network team matchup.
Figure 52:
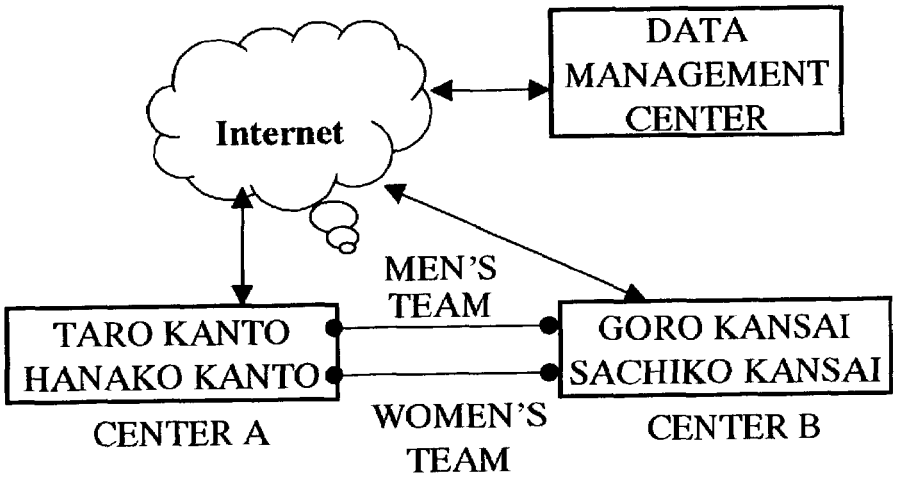
FIG. 52 is a block diagram showing an image of another example of a network team matchup.

This game has two modes: one in which a team in one bowling center and another team in another bowling center plays a match via a network; and the other in which bowlers located in a plurality of bowling centers make teams whose member combination is arbitrarily made among the bowlers, in order to play a match. Shown in FIG. 51 is an image of a Net team match played by two teams formed within bowling centers A and B, respectively. Also illustrated in FIG. 52 is an image of a Net team match played by one team of men and the other team of women, wherein the two teams are formed by the men and women respectively, out of mixed groups in bowling centers A and B. In the Net team match shown in FIG. 51, a team chooses an opposing team by use of the display screen on the information terminal. Since the opposing team's profile is preferably made known on this occasion, multimedia information including voices and still and moving images is made exchangeable as communication information via the bulletin board.

Figure 53:
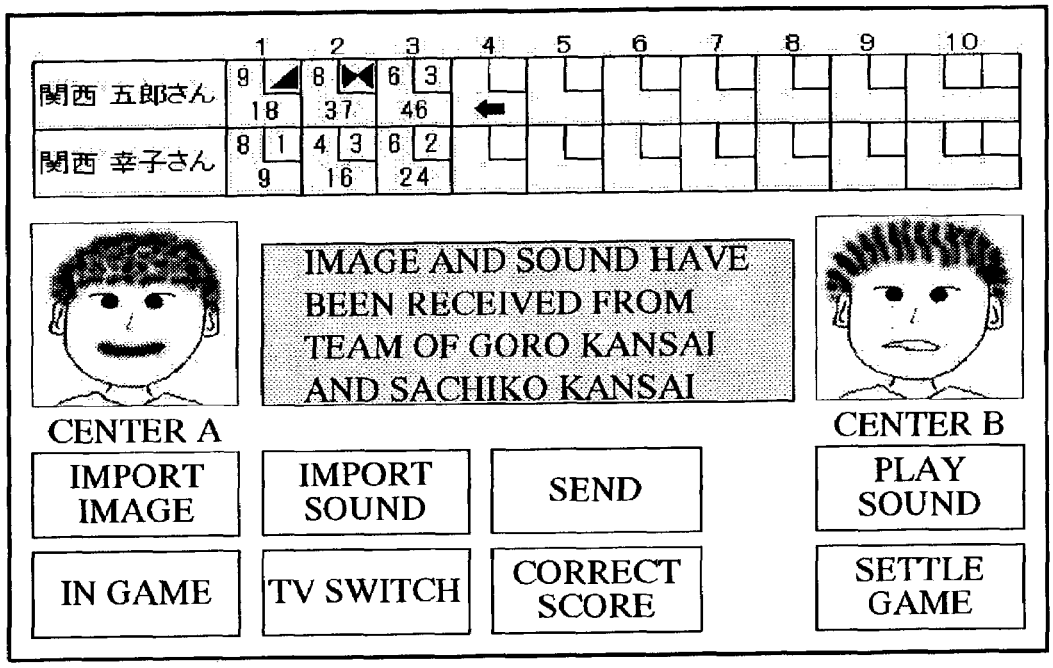
FIGS. 53 and 54 show examples of screen display for network team matchups on the information terminal.

Displayed on the information terminal during the game is, for instance, a display screen as shown in FIG. 53. More specifically, images of the bowlers in the bowling centers A and B are imported respectively and displayed on the display screen. On the occasion voices of the opposing bowlers can also be played by pressing a sound play button 53-1.

Figure 54:
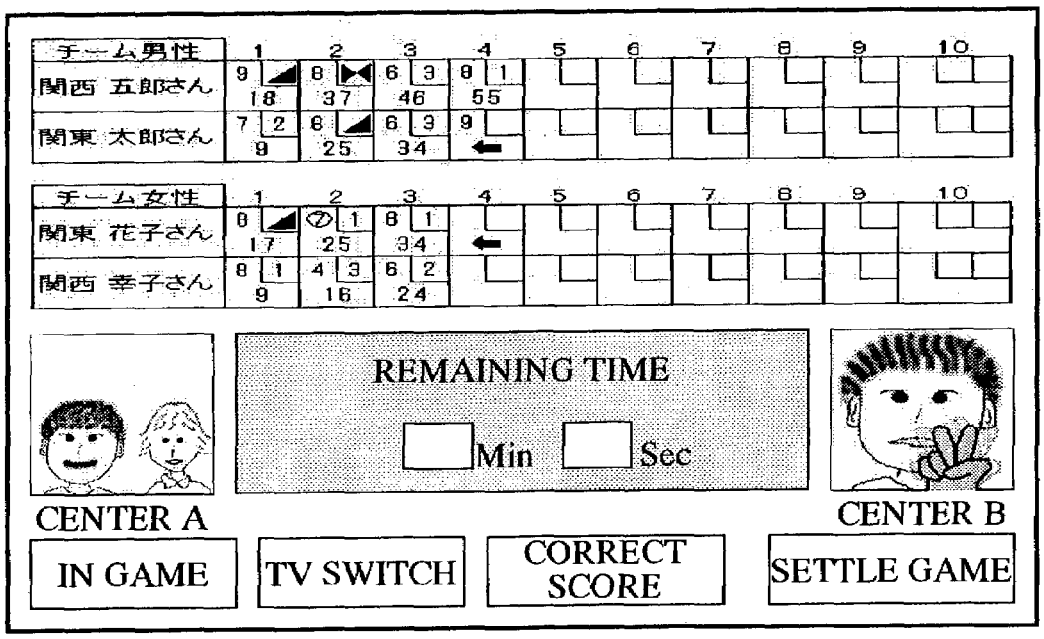

In the Net team match shown in FIG. 52 with an inter-center combination of team members, further, choice of teams is made on the display screen on the information terminal, although team members of each team are composed of bowlers located in remote bowling centers. For example, as shown in FIG. 54 is a screen displayed during the game.

The Net team match enables an inter-center combination of team members, as described above, thereby further increasing amusement of a bowling game.

(Showdown Bowling)

In the showdown bowling, a bowler seeks by use of the bulletin board opponents to play a remote showdown game with via the Internet. Once the showdown game is started, mutual communication between the players becomes possible through multimedia information including images and voices.

The present invention enables a remote bowling game to be held among bowling centers far apart from one another via the Internet, thereby allowing for a much wider variety of types of bowling game, as well as the foregoing.

Enabling these various types of game, the present invention can be expected to promote the sport of bowling to a previously unimagined degree.

The distinguishing features of the present invention are:

that the information terminals are provided one for each lane;

that the center system of each bowling center for processing transaction information, and the data management center for processing and storing transaction information in a centralized way are connected via a general-purpose network such as the Internet;

that the center system transmits game information to the data management center with each game progress made within at least a frame;

that the center system receives from the data management center game progress information according to a game type, processes the information, and then displays the processed result on the information terminals;

that the information terminals to which the above-mentioned result is transmitted are information terminals which have been registered with the data management center;

that the bulletin board is provided in the data management center, for enabling mutual communication among bowlers at remote locations; and that the bulletin board is a medium via which multimedia information, such as still and moving images and voices, can be exchanged among bowlers.

These features have been totally absent in conventional bowling systems, are highly innovative and therefore drastically increase fun of bowling games, with the possibility of largely promoting the sport of bowling.

Advantageous effects according to the present invention are as follows.

(1) A bowling game can be played in real time among bowling centers far apart from one another, since game information is transmitted to the data management center with each game progress made within at least a frame.

(2) The bulletin board for communication can be used for registering bowlers' profile, indicating bowlers' intention to participate in a matchup game, displaying game scores after a game is over, etc. With its functions of registration, posting, search, selection, and retrieval of information, the bulletin board enables bowlers who are totally unacquainted to know one another's profile. This results in bowlers being offered opportunities to meet other bowlers, in particular, of the opposite sex. The present invention offers not a mere Internet-based meeting place but opportunities to meet through the sport of bowling. Meeting another person of the opposite sex is very natural through a bowling game, and adds to fun of the bowling game in turn. The use of the bulletin board also enables non-participant bowlers in a bowling game easily to see game scores and the like.

(3) It can be expected that a bowling game will be fun because of multimedia information being made exchangeable.

The multimedia information can be also exchanged at any time during a game.

(4) The settlement server provided enables fair, quick, and accurate calculation of the cost of running the data management center and all the expenses related to a bowling game according to predetermined rules, and thus facilitates addition of a premium based on the game result. The settlement server also facilitates settlement using bank accounts.

(5) Advertising on the information terminals enables allotment of advertisement revenues to each bowling center.

(6) Included in games using the foregoing system are "Net Tournament," "Net Competition," "Challenge Match," "Group Blind Date Bowling," "Showdown," "Team Match with an inter-center combination of team members," etc., and all of these games are only possible in the bowling system using network according to the present invention. These games are novel ones, totally unobtainable in conventional bowling systems, and therefore serve to promote the sport of bowling.

INDUSTRIAL APPLICABILITY

The present invention is applicable to conventional bowling systems where computer systems are in use for game control.

The invention claimed is:

1. A bowling system comprising:

a center system of a bowling center comprising information terminals to interface with bowlers which are provided one for each lane and calculate, every one frame, game information including a game score obtained by counting how many pins fell when a bowler rolled a bowl, and further processing transaction information including the game information or sales information; and a data management center which is connected with the center system of each bowling center via a general-purpose network, comprising a game information distribution destination table with which game information distribution destinations, inclusive of at least IDs (identification data) of center systems and IDs of information terminals, which are registered beforehand such that the data management center processes and stores the transaction information therein in a centralized way, wherein the center system, as well as transmitting to the data management center the game information of bowlers with each game progress made within at least a frame, receives from the data management center game progress information according to a game type, processes the game progress information, and displays a processed result on the information terminals; and the data management center transmits game information received from the center system to all center systems registered beforehand with the game information distribution destination table, thereby enabling a play of a bowling game among bowlers located at remote locations by transmitting game score data with each other via the general-purpose network.

2. The bowling system using network according to claim 1, wherein the data management center is provided with a bulletin board where communication information of bowlers located in respective bowling centers are registered, thereby enabling the bowlers in the respective bowling centers to exchange communication information with one another.

3. The bowling system according to claim 2, wherein each information terminal has a camera for taking bowlers' face images and a microphone for picking up sound generated by bowlers connected thereto, such that multimedia information including the bowlers' face images taken with the camera and sound picked up through the microphone can be registered as communication information on the bulletin board.

4. The bowling system according to claim 2, wherein the game type is a match-up played by solo bowlers or teams of bowlers among a plurality of bowling centers in which the bulletin board has information on bowlers or teams of bowlers who hope to play a match-up with solo bowlers or teams of bowlers registered thereon as communication information thereby enabling bowlers with their information registered on the bulletin board to be selected as opponents in a match-up, and the center system receives and processes game progress information of the match-up, and displays the processed result on the information terminals provided for lanes where bowlers participating in the game are located.

5. The bowling system using network according to claim 1, wherein the data management center is provided with a settlement server for settling expenses regarding network-related games incurred by each bowling center.

6. The bowling system according to claim 1, wherein the game type is a tournament held among a plurality of bowling centers in which the center system receives the game progress information in other bowling centers, processes the game progress information, and displays the processed result on the information terminals, at request of bowlers in each bowling center.

7. The bowling system according to claim 1, wherein the game type is a competition held among a plurality of bowling centers in which the center system receives and processes an interim game result or a ranking list, and displays the interim game result or the ranking list on the information terminals, at request of bowlers in each bowling center.

8. The bowling system according to claim 1, wherein the game type is a challenge match played against past or virtual game information in which the center system receives and processes bowlers' game progress information and past or virtual game progress information against which the bowlers play, in accordance with game progress.

9. A bowling system comprising:

a center system of a bowling center comprising information terminals to interface with bowlers which are provided one for each lane, and further processing transaction information including game information or sales information, and a data management center which is connected with the center system of each bowling center via a general-purpose network thereby processing and storing the transaction information therein in a centralized way, wherein the center system, as well as transmitting to the data management center game information of bowlers with each game progress made within at least a frame, receives from the data management center game progress information according to a game type, processes the game progress information, and displays a processed result on the information terminals; and the data management center transmits game information received from the center system to all center systems registered therewith, thereby enabling a bowling game to be played among bowlers located at remote locations via the general-purpose network, and the data management center is provided with a settlement server for settling expenses regarding network-related games incurred by each bowling center;

wherein the settlement server also makes settlement of advertising revenues to be allotted to each bowling center.

10. A bowling system using network comprising:

a center system of a bowling center comprising information terminals to interface with bowlers which are provided one for each lane, and further processing transaction information including game information or sales information; and a data management center which is connected with the center system of each bowling center via a general-purpose network thereby processing and storing the transaction information therein in a centralized way, wherein the center system, as well as transmitting to the data management center game information of bowlers with each game progress made within at least a frame, receives from the data management center game progress information according to a game type, processes the game progress information, and displays a processed result on the information terminals;

the game type is a tournament held among a plurality of bowling centers in which the center system receives game progress information in the other bowling centers, processes the game progress information, and displays the processed result on the information terminals, at request of bowlers in each bowling center; and the data management center transmits game information received from the center system to all center systems registered therewith, thereby enabling a bowling game to be played among bowlers located at remote locations via the general-purpose network, and the data management center is provided with a bulletin board where a ranking list for the tournament is registered, which can be viewed arbitrarily by any one with an access right thereto.

11. A bowling system comprising:

a center system of a bowling center comprising information terminals to interface with bowlers which are provided one for each lane and calculate, every one frame, game information including a game score obtained by counting how many pins fell when a bowler rolled a bowl, and further processing transaction information including the game information or sales information; and a data management center which is connected with the center system of each bowling center via a general-purpose network, comprising a game information distribution destination table with which game information distribution destinations, inclusive of at least IDs (identification data) of center systems and IDs of the information terminals, which are registered beforehand such that the data management center processes and stores the transaction information therein in a centralized way, wherein the center system, as well as transmitting to the data management center game information of bowlers with each game progress made within at least a frame, receives from the data management center game progress information according to a game type, processes the game progress information, and displays a processed result on the information terminals; and the data management center transmits game information received from the center system to all center systems registered beforehand with the game information distribution destination table, thereby enabling a play of a bowling game among bowlers located at remote locations by transmitting game score data with each other via the general-purpose network;

wherein the data management center is provided with a bulletin board where communication information of bowlers located in respective bowling centers are registered, thereby enabling the bowlers in the respective bowling centers to exchange communication information with one another;

wherein the game type is a match-up played by solo bowlers or teams of bowlers among a plurality of bowling centers in which the bulletin board has information on bowlers or teams of bowlers who hope to play a match-up with solo bowlers or teams of bowlers registered thereon as communication information thereby enabling bowlers with their information registered on the bulletin board to be selected as opponents in a match-up, and the center system receives and processes game progress information of the match-up, and displays the processed result on the information terminals provided for lanes where bowlers participating in the game are located; and wherein in a case of a team match-up the bulletin board enables an option of making a team of bowlers who are located in a plurality of bowling centers.

* * * * *